US006951590B2

(12) United States Patent
Zafiroglu et al.

(10) Patent No.: US 6,951,590 B2
(45) Date of Patent: Oct. 4, 2005

(54) STITCHED PILE SURFACE STRUCTURE AND PROCESS AND SYSTEM FOR PRODUCING THE SAME

(75) Inventors: Dimitri Peter Zafiroglu, Wilmington, DE (US); Paul Felix Pustolski, Newark, DE (US)

(73) Assignee: Invisia North America S.a.r.l., Wilmington, DE (US)

( * ) Notice: Subject to any disclaimer, the term of this patent is extended or adjusted under 35 U.S.C. 154(b) by 0 days.

(21) Appl. No.: 10/314,693

(22) Filed: Dec. 9, 2002

(65) Prior Publication Data

US 2003/0070739 A1 Apr. 17, 2003

Related U.S. Application Data

(62) Division of application No. 09/260,749, filed on Mar. 2, 1999.

(51) Int. Cl.[7] ..... B32B 31/26; D05C 15/16

(52) U.S. Cl. ..... 156/72; 156/229; 156/435; 428/98; 112/2.2; 112/7; 112/80.01; 112/475.23

(58) Field of Search ..... 156/72, 435, 229; 428/95–97; 112/2.2, 7, 80.01, 475.23

(56) References Cited

U.S. PATENT DOCUMENTS

| | | | |
|---|---|---|---|
| 1,827,614 | A | 10/1931 | Riviere |
| 2,261,096 | A | 10/1941 | Reinhardt |
| 2,429,281 | A | 10/1947 | Solins |
| 2,448,928 | A | 9/1948 | Stahl |

(Continued)

FOREIGN PATENT DOCUMENTS

| | | |
|---|---|---|
| DE | 2935387 | 3/1981 |
| DE | 3119636 | 6/1982 |
| DE | 244582 | 4/1987 |
| DE | 4228563 | 3/1994 |

(Continued)

OTHER PUBLICATIONS

Mayer, Karl. Tricot Machine pamphlet. Jan. 15, 1997.
Mohawk Commercial Carpet Pamphlet, dated Nov. 1994.
Malimo®, *Sewing–Knitting Machines, Six machine types for the manufacture of the most various textile fabric constructions made of fibres and threads.* 1974.
Teppich–Wirkmaschine Carpet Knitting Machine, Model 14 125, pamphlet.

*Primary Examiner*—Sam Chuan Yao

(57) ABSTRACT

A stitched pile surface structure and a process and apparatus for producing and finishing the same is disclosed. The stitched pile surface structure includes a backing having a thickness T. A plurality of parallel lines of stitches extends longitudinally along the backing. Each stitch has a predetermined stitch length dimension S. A plurality of rows of pile elements (either as loop pile or cut pile) is formed from one or more pile yarn(s) having an effective predetermined yarn diameter D. The total weight of the yarn used to form the pile loop elements is G grams.

Substantially all of the stitches have a thread length DKL that satisfies the relationship:

$$DKL <= D\cdot(1+\pi/2)+(2\cdot T)+(2\cdot S)$$

A mass of binder material having a weight of less than G grams is disposed on the pile surface structure. The major portion of the binder material is concentrated in the vicinity of the root portions of the pile elements so that substantially all of the filaments in the distended regions of the root portion of substantially all of the pile elements. The upper two-thirds of substantially all of the pile elements are substantially free of binder.

32 Claims, 24 Drawing Sheets

U.S. PATENT DOCUMENTS

| | | | | |
|---|---|---|---|---|
| 2,892,331 A | | 6/1959 | Kelley | |
| 3,009,235 A | | 11/1961 | De Mestral | |
| 3,070,983 A | | 1/1963 | Hubbard et al. | |
| 3,109,302 A | | 11/1963 | Vitek | |
| 3,168,883 A | | 2/1965 | Ploch et al. | |
| 3,230,917 A | | 1/1966 | Wignall et al. | |
| 3,253,426 A | | 5/1966 | Mauersberger | |
| 3,325,323 A | * | 6/1967 | Forkner | 156/72 |
| 3,401,657 A | | 9/1968 | Watkins | |
| 3,602,011 A | | 8/1971 | Barton et al. | |
| 3,677,206 A | | 7/1972 | Maclsaac, Jr. et al. | |
| 3,722,442 A | | 3/1973 | Maclsaac, Jr. et al. | |
| 3,727,433 A | | 4/1973 | Hamano | |
| 3,837,943 A | | 9/1974 | Ploch et al. | |
| 4,026,129 A | | 5/1977 | Sternlieb | |
| 4,103,630 A | | 8/1978 | Wignall | |
| 4,159,360 A | | 6/1979 | Kim | |
| 4,192,159 A | | 3/1980 | Kohl | |
| 4,244,312 A | | 1/1981 | Bialy | |
| 4,347,718 A | | 9/1982 | Haverland et al. | |
| 4,406,309 A | | 9/1983 | Czelusniak, Jr. | |
| 4,502,902 A | | 3/1985 | Zurcher et al. | |
| 4,619,853 A | | 10/1986 | Blyth et al. | |
| 4,624,878 A | | 11/1986 | Evans et al. | |
| 4,818,316 A | | 4/1989 | Weinle et al. | |
| 4,863,777 A | | 9/1989 | Callaway et al. | |
| 4,871,604 A | | 10/1989 | Hackler | |
| 4,998,421 A | | 3/1991 | Zafiroglu | |
| 5,038,584 A | | 8/1991 | Wildeman | |
| 5,102,482 A | | 4/1992 | Rogers, Jr. | |
| 5,445,860 A | | 8/1995 | Bova | |
| 5,447,590 A | | 9/1995 | Gilpatrick | |
| 5,470,629 A | | 11/1995 | Mokhtar et al. | |
| 5,472,762 A | | 12/1995 | Edwards et al. | |
| 5,498,459 A | | 3/1996 | Mokhtar et al. | |
| 5,510,142 A | | 4/1996 | Groshens | |
| 5,532,035 A | | 7/1996 | Corbin et al. | |
| 5,575,228 A | | 11/1996 | Padgett, III et al. | |
| 5,605,107 A | | 2/1997 | Padgett, III et al. | |
| 5,626,912 A | | 5/1997 | Hendrix et al. | |
| 5,699,593 A | | 12/1997 | Jackson | |
| 5,866,229 A | | 2/1999 | Gartner et al. | |
| 5,902,757 A | | 5/1999 | Stern et al. | |
| 6,338,885 B1 | | 1/2002 | Prevost | |
| 6,521,554 B1 | | 2/2003 | Wildeman | |

FOREIGN PATENT DOCUMENTS

| | | |
|---|---|---|
| DE | 94 11 993.7 | 7/1994 |
| DE | 4335109 | 4/1995 |
| DE | 19506845 | 8/1996 |
| DE | 4417692 | 4/1997 |
| EP | 0529575 | 3/1993 |
| EP | 0568916 | 11/1993 |
| EP | 0347206 | 6/1998 |
| GB | 1074741 | 7/1967 |
| GB | 1 427 191 | 5/1976 |
| GB | 2140047 | 11/1984 |
| JP | 37-12031 | 8/1962 |
| JP | 43-20277 | 8/1968 |
| JP | 63-203854 | 8/1988 |
| JP | 247352 | 2/1990 |
| JP | 6128862 | 10/1992 |
| JP | 291447 | 11/1996 |
| WO | WO 9803711 | 1/1998 |
| WO | WO 0052246 | 9/2000 |

* cited by examiner

STITCHED PILE SURFACE STRUCTURE AND PROCESS AND SYSTEM FOR PRODUCING THE SAME

CROSS-REFERENCE TO RELATED APPLICATIONS

This application is a divisional of copending application Ser. No. 09/260,749, originally filed on Mar. 2, 1999, in the names of Dimitri Peter Zafiroglu and Paul Felix Pustolski.

Subject matter disclosed herein is disclosed and claimed in the following copending application:

Apparatus for Producing A Stitched Pile Surface Structure", filed contemporaneously in the names of Dimitri Peter Zafiroglu and Raymond Alan Roe (RD-7830), which granted as U.S. Pat. No. 6,269,759 on Aug. 7, 2001.

BACKGROUND OF THE INVENTION

The present invention relates to a pile surface structure (or "carpet") having pile elements that are laid-in and stitched onto a planar backing and further secured by tightening the stitches and concentrating small amounts of thermoplastic or thermoset binder material around the tight stitched roots of the pile elements. The pile elements may be cut or remain uncut. The invention is also related to a process and system for producing and finishing such a pile surface structure. A pile surface structure in accordance with the present invention may be used as a carpet, a velour fabric, an insulative pile sheet, or an impregnation substrate.

DESCRIPTION OF PRIOR ART

Carpets or velour pile structures formed by tufting machines are well-known. Tufted structures contain tufts in the form of uncut or cut loops inserted into a "primary" backing. A portion of the pile yarn remains on the back face of the backing. The pre-formed tufted backing is then stabilized by applying a relatively heavy layer of adhesive binder material (usually a latex-based material) and, in most cases, a "secondary" backing to the back of the structure. In some cases a layer of thermoplastic material is introduced between the primary and secondary backings to replace the adhesive binder material.

One limitation of these products is that they require relatively heavy primary backings that can hold the tufts securely until the adhesive binder material and secondary backing are applied. A second limitation is that the adhesive binder material and secondary backing add substantial weight. A third limitation is the considerable portion of the tufting yarn is placed under the primary backing, between the primary and secondary backings. This construction leaves the face of the primary backing exposed between tuft-penetration points, requiring a relatively dense pattern of loops or cut-tufts. Furthermore, "tuft-bind," or the force required to pull cut tufts or to unravel uncut loop tufts, is limited, unless a large weight of binder material is used to penetrate the backings and the pile yarn located between the two backings.

Flat, stitch-bonded structures are also known in the prior art. FIG. 1A is a stylized perspective view of a typical apparatus generally indicated by the reference character 10 for forming a flat, stitch-bonded structure 12 having "laid-in" yarn inlay elements 54 overstitched with a stitching thread. FIGS. 1B and 1C illustrate stylized front and side elevational views of the stitch-bonded structure 12 so produced. It should be noted that in FIGS. 1A through 1C, for purposes of illustration, the yarn 48Y used to form the yarn inlays 54 is shown as being a relatively heavy and bulky yarn of the type typically used to form carpet pile, while the thread 48T (shown in dashed lines in FIG. 1A) used to form the chain stitches 56 is of significantly finer denier.

Each yarn inlay 54 in each of the plural rows of inlays is attached at spaced points to a first, top, surface 14S of a planar backing 14 by the underlap portions 56U of the chain stitches 56. The stitches 56 are linearly interlocked with themselves by overlap portions 56L (FIG. 1B) formed over the second, bottom, surface 14B of the backing 14. A representative stitching apparatus similar in structure and operation to that described herein is manufactured and sold under the Trademark "Malimo" by Karl Mayer Textilmaschinenfabrik GmbH, Obertshausen, Germany.

The stitching apparatus 10 may include a slotted platen 20 that supports the backing 14 along a generally planar path of travel extending longitudinally through the apparatus 10. The slots in the platen 20 are not visible in FIG. 1A. The longitudinal direction of travel of the backing 14, also termed the "machine direction", is indicated by the reference arrow 24. As used throughout this application the longitudinal direction of travel aligns with the longitudinal (or "warp") direction of a pile surface structure being produced, while the direction transverse to the warp direction is termed the "cross", "transverse" or "weft" direction of the pile surface structure being produced.

It is noted that the path of travel of the backing 14 through the apparatus 10 is arbitrarily shown in FIG. 1A as a horizontal path. The backing 14 is supplied to the platen 20 from a suitable supply roll (not shown in FIG. 1A). In the stitch-bonded structure 12 produced by the apparatus of FIG. 1A the backing 14 typically takes the form of a lightly needled staple "fleece", a lightly bonded card web, or a spunlaced sheet. None of these typical backing materials is dimensionally stable. Accordingly, the main purpose of a stitch-bonding operation is to impart stability to the backing 14 in both its longitudinal and cross directions.

The backing 14 is conveyed incrementally in the machine direction 24 by a suitable propelling arrangement, such as a pull roll (not shown in FIG. 1A). Optionally, a hold-down plate downstream of the needle plane may support the backing against the platen in that region. The hold-down plate is omitted from FIG. 1A for clarity of illustration.

At the inlet edge of the platen is a sinker bar 28. The sinker bar 28 extends transversely across the apparatus 10. A plurality of sinker fingers 30 extends forwardly from the sinker bar 28 in the machine direction 24. Each sinker finger 30 is spaced from a laterally adjacent finger 30 by a predetermined lateral spacing 32. The top surface of each sinker finger 30 is indicated by the character 30T, while the undersurface of each sinker finger 30 is indicated by the character 30S. The upper surface 20S of the platen 20 and the undersurface 30S of each sinker finger 30 cooperate to define a throat 34 into which the backing 14 is introduced into the apparatus 10.

A needle bar 40 having a plurality of penetrating needles 42 thereon is mounted beneath the platen 20. Each needle 42 may include a closure (not illustrated). The needle bar 40 is spaced a predetermined distance forwardly of the ends 30E of the sinker fingers 30. The needles 42 extend upwardly through the slots in the platen 20. The needle bar 40 is movable by a suitable actuator (not shown) such that the needles 42 are displaceable in vertically reciprocating fashion in a needle plane 44 located forwardly of the ends 30E of the sinker fingers 30 and normal to the path of travel. Each of the reciprocating needles 42 intersects and penetrates the backing 14 at a respective needle penetration point 46. Each needle penetration point 46 is located in the transverse spacing 32 defined between laterally adjacent sinker fingers 30. The transversely extending line of needle penetration points 46 lies in the needle plane 44.

A plurality of guide bars 50 is mounted above the sinker fingers 30 and above the planar path of travel of the backing 14 through the apparatus 10. Although a typical stitching apparatus may include up to four such guide bars, for clarity of illustration only the guide bars 50T, 50Y are illustrated in FIG. 1A. Each guide bar 50T, 50Y has a plurality of downwardly depending guide elements. The guide elements may be implemented as circular eyelets, as illustrated, or may take the form of tubular members or wide spoon guides, if desired.

The guide elements on the guide bar 50Y serve to carry the yarns 48Y that are laid into the top surface 14S of the backing 14. Each yarn 48Y is dispensed from a beam or from an individual bobbin mounted on a creel rack (not shown in FIG. 1A) and passes through a guide element on the yarn guide bar SOY. The guide elements on the other guide bar 50T carry the stitching threads 48T that hold the yarns 48Y to the backing 14. Each stitching thread 48T is dispensed from a separate beam or from a bobbin mounted on a creel (not shown in FIG. 1A).

Each guide bar 50Y, 50T is independently movable in various degrees of freedom by a suitable actuating arrangement (not shown). Typically, each guide bar 50Y, 50T may be swung transversely, forwardly, and/or backwardly with respect to any other guide bar. Thus, the yarns 48Y and/or the threads 48T carried on the guide bars SOY, 50T may be displaced with respect to the backing 14, and/or looped or interlocked with each other in a variety of fashions.

In operation, the backing 14 is introduced from the supply roll into the throat 34 defined between the platen 20 and the sinker fingers 30. The bottom surface 14B of the backing 14 is supported on the platen 20 while the top surface 14S is presented to the undersurface 30S of the sinker fingers 30. The dimension 34T of the throat 34 is larger than the thickness dimension 14T of the backing 14, so that the backing 14 is relatively loosely confined between the sinker fingers 30 and the platen 20 as the backing 14 is advanced along its path of travel through the apparatus 10.

Since the formation of laid-in yarn inlays 54 and the securement of those inlays 54 to the top surface 14S of the backing 14 by the underlaps 56U of the stitches 56 is sufficiently well understood, only a brief description of the process need be described.

The backing 14 is conveyed along the path of travel so that successive transversely extending regions of the backing 14 are advanced into the needle plane 44. Before and after the yarn guide bar 50Y is transversely displaced to dispense the length of yarn that eventually forms the inlay 54 on the surface 14S of the backing 14, stitching threads 48T from adjacent first and second thread guides on the thread guide bar 50T are successively looped around respective first and second locations on the dispensed length of yarn 48Y.

As successive transverse regions of the backing 14 move into the needle plane 44, adjacent first and second needles, e.g., the needles 42-1, 42-2, are actuated and raised through the backing at penetration points 46-1, 46-2, to positions above the path of travel. In the raised positions the adjacent first and second needles 42-1, 42-2 respectively successively engage the looped first and the second stitching threads 48T-1, 48T-2 and draw these stitching threads downwardly toward the backing 14. These actions draw the length of dispensed yarn 48Y to the surface 14S of the backing 14, thereby forming a yarn inlay 54 that extends transversely and diagonally over the first surface 14S of the backing 14. Continued downward movement of each needle 42-1, 42-2 through the backing 14 forms an underlap portion 56U of a chain stitch 56. The underlap portion 56U (FIG. 1B) of the stitch 56 overlies the first surface 14S of the backing 14 and secures the yarn inlay 54 against that first surface 14S. Each stitch 56 also includes an interlockable looped overlap portion 56L that lies against the bottom surface 14B of the backing 14. The arrangement of longitudinally extending overlap portions 56L of the chain stitches 56 on the bottom surface 14B of the backing 14 is best shown in the side elevational view of FIG. 1B.

For each successive longitudinal advance of a region of the backing 14 through the needle plane 44 each needle alternately cooperates with one of its laterally adjacent needles to form a yarn inlay element 54 that extends across the top surface 14S of the backing 14. As a result, as shown in the perspective view of FIG. 1A, the action of the thread guide bars 50T and the needles 42 forms a plurality of lines 58 of interlocked stitches 56, with each stitch 56 including an underlap portion 56U and an overlap portion 56L. Sequential overlap portions 56L interlock with each other, chain-fashion. The stitch lines 58 extend longitudinally in parallel along the backing 14. The frequency of stitches 56 is usually given in units of "courses", which indicate the number of stitches 56 per unit length of stitch line 58. Each stitch line 58 is spaced from an adjacent stitch line 58 by a predetermined stitch spacing, or "wale", W. The distance between longitudinally successive needle penetration points 46 in any given stitch line 58, termed the "stitch length", is indicated by the reference character "S".

Each yarn inlay 54 has a generally U-shaped configuration comprising a root portion 60 (FIG. 1C) with two branches 60B extending therefrom. The root portion 60 of the inlay 54 is held against the surface 14S of the backing 14 by the underlap portion 56U of a stitch 56. Each branch of a given yarn inlay 54 in one row is joined to a branch 60B of a yarn inlay 54 in an adjacent row to define a zig-zag array of inlays 54 on the top surface 14S of the backing 14. In the terminology of the art this arrangement of inlays 54 and stitching thread underlaps 56U may be identified as a reciprocating 0-0/2-2 stitch, or "tricot" stitch. "Laid Atlas" stitches such as 0-0/2-2/2-2/4-4/4-4/2-2/2-2/0-0, or longer laid stitches such as 0-0/3-3 or 0-0/4-4, may also be used.

As is seen in the front elevational view of FIG. 1C each yarn inlay 54 is substantially flat, that is, it lays directly against the first surface of the backing. The height of any vertical clearance, or gap (if one is present) between the yarn inlay 54 and the first surface 14 of the backing 12 is diagrammatically indicated in FIG. 1C by the reference character "h". In prior art laid-in stitch bonded structures the ratio h/W is substantially equal to zero.

In another well-known form of yarn structure 12' (FIG. 2A) the yarn 48Y is stitched into a backing 14 that is dimensionally stable in both its longitudinal and cross directions without the use of an overstitching thread. This form of stitched-in structure is typically used for towels, insulation structures, and wall coverings. FIG. 2A is a perspective view of an apparatus 10' used to produce this form of stitched-in yarn structure 12'. A commercially available apparatus similar in structure and operation to that described in connection with FIG. 2A is manufactured and sold under the Trademark "Malipol" by Karl Mayer Textilmaschinenfabrik GmbH, Obertshausen, Germany. Except for the distinctions to be noted the apparatus 10' is substantially identical to the prior art stitching apparatus 10 shown in FIG. 1A. Accordingly, identical reference characters are used for identical structural elements, while modified elements or modified structural relationships will be indicated by single primed reference characters.

One difference between the apparatus 10 of FIG. 1A and the apparatus 10' of FIG. 2A lies in the structure of the sinker fingers 30' and their disposition with respect to the needle penetration points 46. In the apparatus 10' the sinker fingers 30' extend forwardly (in the machine direction 24) beyond the needle penetration points 46. In addition, the portion of the fingers 30' forward of the needle penetration points 46 taper downwardly toward the backing 14. Since an overstitching thread 48T is not used since the apparatus 10' requires only the yarn guide bar 50Y.

In operation, a given yarn 48Y is engaged by adjacent needles 42 to form yarn elements 54' that are stitched-into the backing 14. A basic tricot stitch, such as a 1-0/1-2 stitch across two stitch rows, is typically formed. As the yarn 48Y is drawn by the needles toward the backing 14 the extension of the sinker finger 30' past the needle penetration points 46 prevents the yarn elements 54' from being drawn flat against the top surface 14T of the backing 14. Thus, each yarn element 54' exhibits an inverted loop portion 60L' that overlies the top surface 14S of the backing 14. As is illustrated in FIGS. 2A and 2B interlocking chain overlaps 56L' are formed adjacent the second (bottom) surface 14B of the backing 14. The loop portion 60L' of each yarn element 54' emanates from the needle penetration point 46, imparting a generally V-shaped configuration to the yarn element 54' in the vicinity of the surface 14S. Owing to the forward taper of the sinker fingers 30', as the backing 14 is advanced in the machine direction 24, the loop portions 60L' of the yarn elements 54' are easily doffed from the fingers.

The vertical clearance between the looped yarn element 54' and the top surface 14S of the backing 14 is again diagrammatically indicated in FIG. 2C by the reference character "h", while the spacing between adjacent longitudinally extending stitch lines 58' is again indicated by the reference character W. The apparatus 10' produces a pile structure 12' in which the ratio h/W of the loop height h to the stitch spacing W is substantially greater than zero.

Looped yarn structures 12" may also be formed using an array 16 of cross-laid weft-inserted yarns in lieu of a dimensionally stable backing. FIG. 3A illustrates a prior art apparatus 10" for forming this type of yarn structure 12". As is the case for the other illustrated prior art apparatus identical reference characters are used for identical structural elements, while modified structural elements or modified structural relationships will be distinguished by double primed reference characters.

Similar to the arrangement of FIG. 2A the apparatus 10" includes forwardly extending sinker fingers 30". The portion of the fingers 30" that extend forwardly past the needle penetration points 46 may have a substantially uniform height dimension 30H". As is the case for the arrangement of FIG. 1A the apparatus 10" includes both a yarn guide bar 50Y and a thread guide bar 50T.

The presence of the extending fingers 30" forms each yarn element 54" having an elevated pile loop 60L". As seen in FIGS. 3A and 3B the U-shaped root portion 60" of each yarn element 54" in each row of elements is secured to the weft yarns in the array 16 by an underlap 56U" of stitching thread. The point of contact between a weft yarn 16 and an underlap 56U" is indicated by the character 56M". The stitching threads 48T" are longitudinally interlocked by chained overlap portions 56L" that extend under the weft yarns 16. Adjacent stitch lines 58" are spaced transversely by the distance W. When only weft-inserted yarns are used the yarn elements 54" so formed tend to pull the stitching thread 48T and weft yarn 16, causing them to deflect upwardly in the lateral spacing 32" between the adjacent sinker fingers 30", as shown in FIG. 3C. Each loop portion 60L" of each yarn element 54" has a height dimension h, as measured from a reference plane P containing contact points 56M", thus imparting to the yarn structure 12" a h/W ratio greater than zero.

A commercially available apparatus similar in structure and operation to that described in connection with FIG. 3A is manufactured and sold under the Trademark "Schusspol" by Karl Mayer Textilmaschinenfabrik GmbH, Obertshausen, Germany. Variations of such apparatus utilizing pre-formed backings have also been suggested in German Democratic Republic Patent 244,582 (VEB Kombinat Textima). The difficulties in penetrating such backings with large amounts of binder to secure the pile loops onto the backing have culminated in using self-formed weft-inserted open backings as in the product produced by the apparatus of FIG. 3A, in preference to pre-formed, pre-stabilized backings.

Also known in the art are various knitting apparatus. One example of such apparatus is manufactured and sold under the Trademark "HKS 4-1" by Karl Mayer Textilmaschinenfabrik GmbH, Obertshausen, Germany. This apparatus is similar to that described in connection with FIG. 2A in that it has tapered sinker fingers that extend forwardly in the machine direction past the needle penetration points. However, in place of a backing that is dimensionally stable in both its length and width directions, the knitting apparatus also forms, in situ, a planar array of tricot stitch underlaps or weft-inserted yarns, similar to that shown in FIG. 3A. The pile yarns are usually knitted-in, with substantial amounts of yarn located below the planar array.

Products such as carpets, velours or velvets can be produced by similar machinery. These products require high stability against surface wear. Therefore, large amounts of binder material are applied from the backside of the structure to stabilize and reinforce the product. Representative of such knit pile structures are the commercial carpets manufactured using a "woven interlock construction" and sold by Mohawk Carpets, Inc., Calhoun, Ga.

FIG. 4 is a stylized front elevation view of a knit pile structure $\mathbf{12}^3$ having yarn element $\mathbf{54}^3$ with an elevated stitched-in pile loop $\mathbf{60}L^3$. The root portion $\mathbf{60}^3$ of each stitched-in pile yarn element $\mathbf{54}^3$ is additionally secured by an underlap $\mathbf{56}U^3$ of a stitch 56 to the weft yarns $\mathbf{16}^3$ that form a backing $\mathbf{14}^3$. The stitches 56 are longitudinally interlocked by chained overlap portions $\mathbf{56}L^3$ that extend under the weft yarns $\mathbf{16}^3$.

A longitudinally extending yarn 59 may be laid over the root portion $\mathbf{60}^3$ of each yarn element $\mathbf{54}^3$ in each stitch line $\mathbf{58}^3$ and is there held by an underlap $\mathbf{56}U^3$ of the stitch 56. A second longitudinally extending yarn 61 is laid under the weft yarn $\mathbf{16}^3$ that and is there held by an overlap $\mathbf{56}L^3$. The yarns 59 and 61 usually serve the purpose of filling or reinforcing the structure. In addition, a planar layer of weft-extending or laid-in yarns 62, 63 are held by the underlaps $\mathbf{56}U^3$ and the overlap portions $\mathbf{56}L^3$ of the stitches 56. These yarns 62, 63 also serve to reinforce the yarn structure $\mathbf{12}^3$.

Each of the above-described known apparatus and processes have attendant disadvantages that are believed to detract from their utility in forming pile surface structures.

For example, the laid-in stitch-bonded structure produced by the apparatus of FIG. 1A is flat, has no pile height, and thus would be disadvantageous for use as a carpet because of the lack of cushion. Stabilization and reinforcement by applying binder from the back to qualify the product as a floor covering would penetrate into the entire length of the laid-in yarns and would stiffen the face yarns, rendering the surface of the product unattractive and harsh.

The apparatus of FIG. 2A is efficient and fast in operation, and the product produced is relatively easy to stabilize and reinforce by the addition of binder material to the back face to secure the overlaps of the pile yarns. Nevertheless, the pile yarn structure produced is believed to exhibit several disadvantages. The loops tend to lean forwardly because of the pull against the interlooped overlaps, and a very large amount of pile yarn is wasted under the backing in the form of chain stitch overlaps. Moreover, the taper of the sinker fingers downstream of the needle penetration plane causes the formed loops to be pulled and shortened, resulting in much lower loop height h as compared to the height of the sinker finger at the needle penetration plane. In addition, the pile loops 60L (FIG. 2C) emerge from a single, highly constricted, needle penetration opening in the backing, thus defining a "V-shape" rather than a "U-shape", thereby minimizing the coverage of the upper surface of the backing by the pile loop.

In the pile structure formed using the apparatus of FIG. 3A the weft-inserted yarns in the array tend to deflect upwardly between the two sinker elements, as shown in FIG. 3C. This has the effect of shortening the pile height. Furthermore, the stitching thread must pull and slide and fully surround two relatively loose yarns (pile and weft) and therefore it must be drawn very tightly. This slows down the process and limits the overall tightness that can be obtained. Moreover, the product is dimensionally unstable because of the absence of multidimensional ties in the backing layer, unless large amounts of adhesive binder are applied through all lower elements to stabilize the structure. Applying large amounts of binder from the back does not necessarily reach the roots of the U-shaped pile yarns to secure all filaments of the pile yarns. Relatively tight chain stitches exacerbate this problem since they tend to limit the propagation of liquid binder into the filaments of the pile yarn in the vicinity of the constricted roots. Converting the system of FIG. 3A into one utilizing a pre-formed stable backing has, to date, caused even more serious problems with sufficient binder penetration to the pile yarns through the backing, and also difficulties in obtaining sufficiently tight chain stitch overlaps to securely hold the pile yarns in place.

In the knit pile structure of FIG. 4 the pile emerges in a "V-shape" rather than a "U-shape", again minimizing the coverage of the upper surface of the backing. Relatively large amounts of pile yarn are consumed in forming the back face of the structure. Although the structure does allow the propagation liquid binder into the roots of the pile elements, relatively large amounts of binder are required to dimensionally stabilize the structure.

In view of the foregoing it is believed desirable to construct a pile surface structure over a prefabricated or in-situ-formed backing held under tight control, with all of the pile loop yarns located over the upper surface of the backing. It is also believed desirable to attach the pile elements to the backing with separate but tight underlaps of finer stitching thread, and to further secure the pile elements with binder primarily concentrated in the tightly constricted roots of the pile yarns. As a result a lightweight, stable and fully erect pile structure, providing maximum pile yarn coverage over the backing is produced.

SUMMARY OF THE INVENTION

The present invention is directed to a stitched pile surface structure and a process and system for producing, and finishing the same. The stitched pile surface structure includes a backing having a first and a second surface and a thickness T. The backing is preferably preformed from a material that is dimensionally stable in both its longitudinal (warp) and cross or transverse (weft) directions. The backing may include a series of weft-extending reinforcing yarns that are introduced under or over the backing to reinforce it in the cross direction. Alternatively, the backing may be comprised of an array of weft-extending yarns.

A plurality of parallel lines of stitches extends longitudinally along the backing, with each line of stitches being spaced from an adjacent line of stitches by a predetermined stitch spacing W. Each stitch includes an underlap portion that extends over the first surface of the backing and an overlap portion that extends over the second surface of the backing. Each stitch has a predetermined stitch length dimension S. A plurality of rows of pile elements is formed from one or more pile yarn(s). Each yarn has an effective predetermined yarn diameter D. The total weight of the yarn used to form the pile loop elements is G grams.

Each pile element has at least one U-shaped root portion that is held and constricted against the first surface of the backing by the underlap portion of one of the stitches. The underlaps are drawn sufficiently tightly against the backing so as to form distended regions on each side of the constriction in the root portion of each pile element.

Preferably, substantially all of the stitches have a thread length DKL that satisfies the relationship:

$$DKL <= D\cdot(1+\pi/2)+(2\cdot T)+(2\cdot S).$$

More preferably, substantially all of the stitches have a thread length DKL that is less than or equal to ninety percent (90%) of the thread length DKL defined by the above-stated relationship, while in the most preferred case, substantially all of the stitches has a thread length DKL that is less than or equal to eighty percent (80%) of the thread length DKL defined by the above-stated relationship. It should be understood that the term "substantially all" as used throughout this application (including the claims) in connection with an element, the term is to be construed to encompass "all or substantially all" of that element.

The underlaps of the stitches may be caused to tighten further around the U-shaped root portions by stretching the pile surface structure, or shrinking the stitching threads, or both.

A mass of binder material is disposed within the pile surface structure. The term "within the pile surface structure" means that portion of the pile surface structure between the top of a pile element (whether loop or cut pile) and the second (lower) surface of the backing. The binder material is present on substantially all of the filaments in the distended regions of the root portion of substantially all of the pile elements. Preferably the upper two-thirds of substantially all of the pile elements are substantially free of binder.

The weight of the binder material disposed within the pile surface structure is preferably less than G grams. Accordingly, the weight G excludes binder material, if any, disposed behind and below the backing or below the reinforcing yarns that may be located below the backing.

The binder material may be applied in the form of a layer of binder material disposed over the first surface of the backing, in a liquid-carried form applied through the backing, in the form of one or more strand(s) of binder material laid over and under the roots of the pile elements, or as part of the stitching threads. If a single strand of binder material is used it is laid longitudinally or transversely either under the stitching thread underlaps against the root portion or between the root portions and the backing.

The backing may be reinforced with weft-extending reinforcing yarns and/or longitudinally extending reinforcing yarns. The reinforcing yarns, if used, are secured to the backing in the desired location by the stitched threads.

An array of weft-extending attachment yarns may be held to the bottom of the backing by the overlap portion of the stitches. Each attachment yarn has a plurality of looped fibers extending therefrom. The looped fibers may be used as "hook" portion of a "hook and loop" fastener system.

In one embodiment the pile elements are formed as loop pile, with each loop pile element including an inverted, substantially erect, loop portion extending over the first surface of the backing between a first U-shaped root portion located in a first longitudinally extending stitch line and a second U-shaped root portion located in a second longitudinally extending stitch line. Each root portion of each loop pile element is held against the first surface of the backing by the underlap portion of one of the stitches. The erect loop portion of each loop pile element extends at least a predetermined erect pile height H from the first surface of the backing.

In an alternate embodiment the loop pile elements are cut, after formation, to form cut pile elements. Each cut pile element has a U-shaped root portion that is held against the first surface of the backing by the underlap portion of one of the stitches. Two substantially erect branches, each terminating in a tip, extend from each U-shaped root portion. The tip of each branch of each cut pile element extends at least a predetermined erect pile height H' from the first surface of the backing.

In a preferred version of either the loop or cut pile embodiments of the pile surface structure in accordance with the present invention the ratio of the predetermined erect pile height H (loop pile) or H' (cut pile), as the case may be, to the predetermined stitch spacing W satisfies the relationship:

$$H/W>0.5 \text{ or } H'/W>0.5.$$

The final pile surface structure is light, stable and has excellent face coverage with relatively small amounts of pile face yarn.

In another aspect the present invention is directed to a process for producing a stitched pile surface structure using a stitching apparatus having first and second needles. In general the process includes using the first and second needles to form a plurality of pile elements and stitching thread underlaps that hold each pile element, thereby to form a pile surface structure. The pile elements have root portions.

More particularly, the process may include the steps of looping a first and a second stitching thread around respective first and second locations along a pile-forming yarn; and, using first and second hooked needles, drawing both the first and the second stitching threads toward and through a backing to cause the pile-forming yarn to train over a sinker finger thereby to form a plurality of pile loop elements each having a pile height substantially equal to the finger height H and to form stitching thread underlaps that hold each pile loop element against the first surface of backing.

In one embodiment the pile surface structure is stretched in the longitudinal direction by at least two to twenty (2%–20%) percent to tighten the stitching threads holding the pile elements. In an alternate embodiment heat sufficient to shrink permanently the stitching threads is applied. The permanent shrinkage of the stitching threads is in the range from about five percent (5%) to about thirty percent (30%).

In an alternative aspect the process may include providing a binder material within the pile surface structure. The binder material may be in the form of a layer of binder material may be disposed over the first surface of the backing, or as one or more strand(s) of binder material laid over and under the roots of the pile elements, or, in a liquid-carried form applied through the backing. The strand(s) of binder material may be longitudinally extending and/or weft-extending.

Thereafter, heat is applied to activate the binder material. The major portion of the binder material is concentrated in the distended portions of the pile yarns in the vicinity of the constricted root portions of the loop pile elements and, preferably, with the upper two-thirds of substantially all of the loop pile elements being substantially free of binder.

To control the height of the pile loop elements the backing is held in place at a set distance from the top of sinker fingers disposed in the stitching apparatus. If the stitching thread is made of a material that is contracts upon the application of heat, the step of activating the binder material simultaneously contracts the stitching thread to tighten the stitching thread underlaps.

Still another optional step is inserting longitudinally extending reinforcing yarns to the backing.

Another optional step is the step of treating of the bottom surface of a prefabricated backing with a material that repels liquid binder material. The repellent material prevents the waste of liquid binder in the bottom surface of the backing and promotes the propagation of binder to the U-shaped roots by capillary action along the stitching threads through the perforations in the backing. An alternative to the repellent treatment is to form the backing as a two-layer structure wherein the material of the bottom layer repels liquid binder.

To produce the pile surface structure having cut pile elements the process further includes the step of cutting the pile loop element with a cutting implement to form a pair of generally U-shaped cut pile elements.

The system for producing a pile surface structure comprises a stitching apparatus for producing a pile surface structure, the pile surface structure including a binder material therein, the binder material being in the form of a thermoplastic solid; and a heating device disposed downstream of the stitching apparatus for activating the binder material.

An applicator for a liquid-carried binder material may be disposed adjacent to the stitching apparatus.

The system may further comprise heating device, which may include a separate cooling section. The system may also include means for controlling the longitudinal and transverse tension on the pile surface structure.

BRIEF DESCRIPTION OF THE DRAWINGS

The invention will be more fully understood from the following detailed description, taken in connection with the accompanying drawings, which form a part of this application and in which:

FIG. 1A is a stylized perspective view of an apparatus for forming a laid-in stitch-bonded structure of the prior art produced by the apparatus of FIG. 1A; while

FIG. 2A is a stylized perspective view, similar to FIG. 1A, of an apparatus for forming a stitch-bonded structure of the prior art; while

FIG. 3A is a stylized perspective view, similar to FIG. 1A, of an apparatus for forming another stitch-bonded structure of the prior art; while

FIG. 7A is a stylized perspective view of a modified apparatus for producing a laid-in stitch-bonded cut pile surface structure; while

DESCRIPTION OF PREFERRED EMBODIMENT

Figure 1:
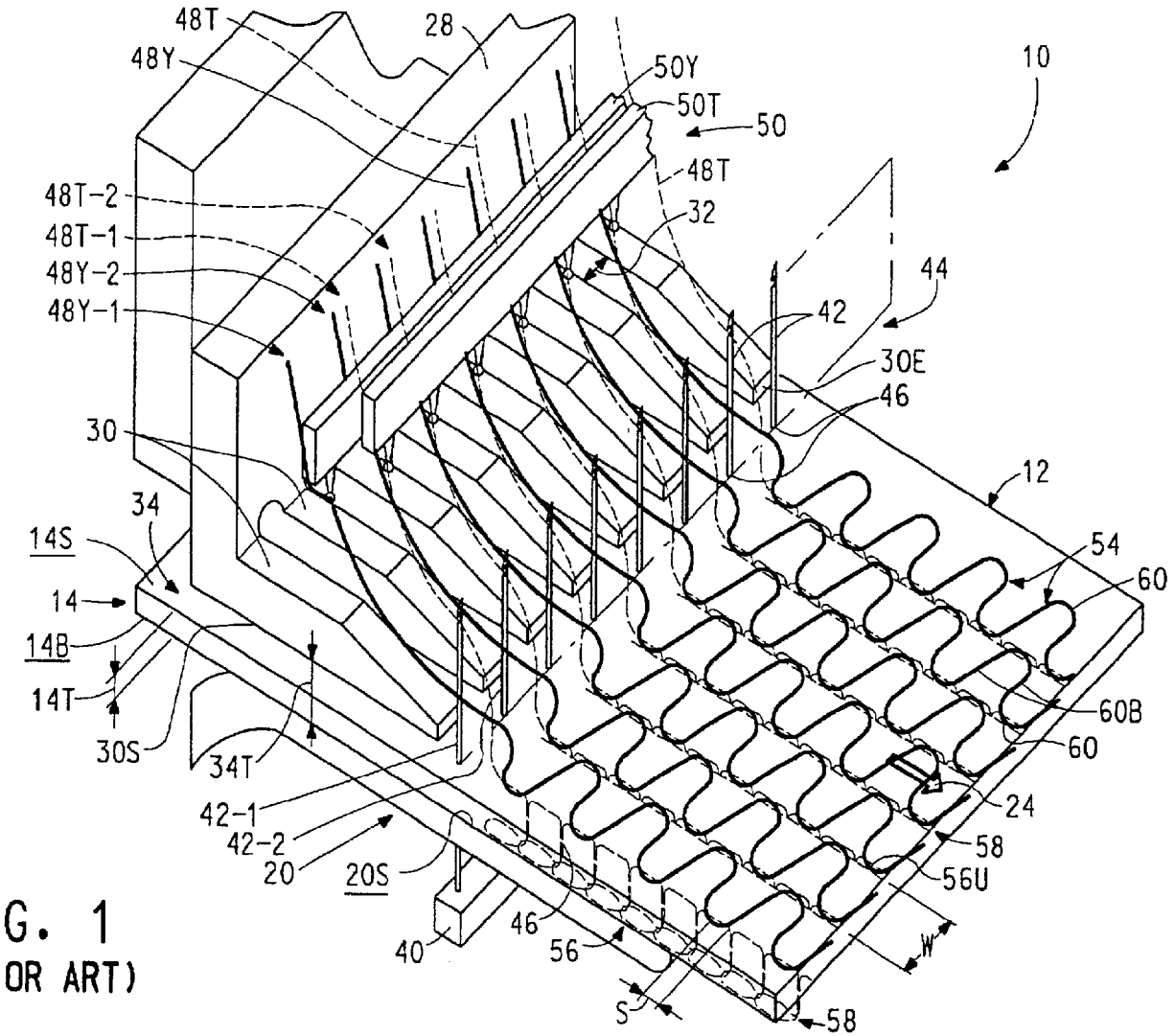
FIG. 1 (PRIOR ART)
Figure 1B:
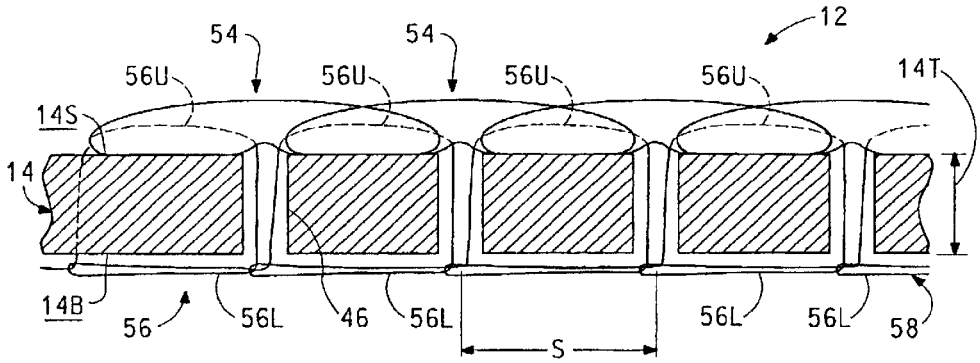
FIG. 1B (PRIOR ART)
FIGS. 1B and 1C are side and front elevational views, respectively, of the laid-in stitch-bonded structure of the prior art produced by the apparatus of FIG. 1A.
Figure 1C:
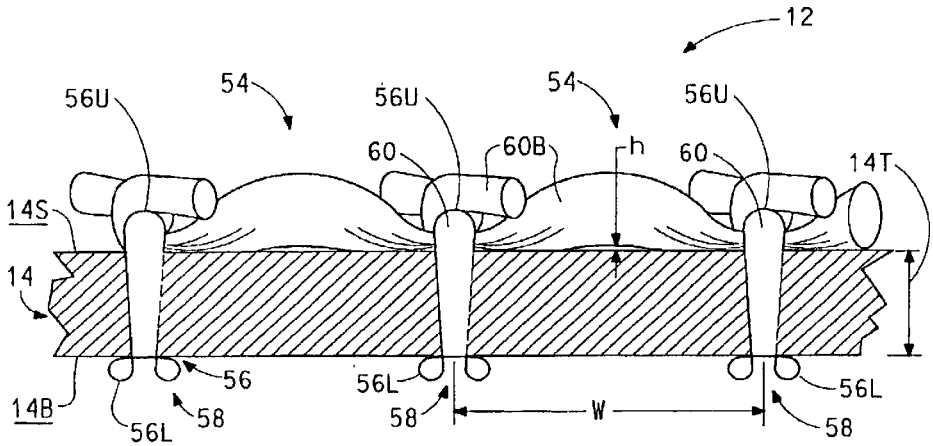
FIG. 1C (PRIOR ART)

Throughout the following detailed description similar reference numerals refer to similar elements in all figures of the drawings.

Figure 5:
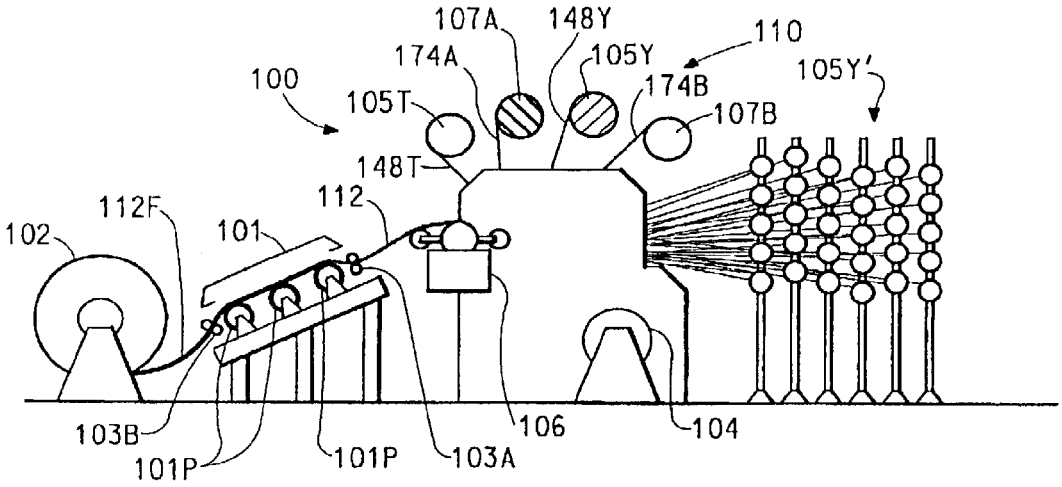
FIG. 5 is a diagrammatic illustration of a system in accordance with the present invention for producing and finishing a laid-in stitch-bonded pile surface structure in accordance with the present invention.

FIG. 5 is a diagrammatic illustration of an overall system 100 for producing and finishing a laid-in stitched pile surface structure in accordance with the present invention. The system 100 includes a stitching apparatus generally indicated by the reference character 110 that is modified in a manner to be described to produce a stitched pile surface structure in accordance with the present invention. The stitched pile surface structure produced at the output of the stitching apparatus is generally indicated herein by the reference character 112.

As will be developed more fully herein the stitched pile surface structure 112 includes a binder material therein. The binder material may be introduced into the pile surface structure in the form of a solid thermoplastic material, such as a component of the stitching thread or as elongated strands of binder material or as a layer or coating of thermoplastic material disposed on the backing. Alternatively, the binder material may be introduced in liquid form, as will be described. The binder material included in the pile surface structure is heat activatable.

Located downstream of the stitching apparatus 110 is a finishing device 101 that finishes the stitched pile surface structure 112 produced by the apparatus 110. The finishing process includes the heat activation of the binder material, the optional stretching of the pile surface structure, and/or the shrinking of the stitching threads. The finishing device 101 includes a heating section and, optionally, a cooling section. The finishing device 101 may be equipped with edge-holding devices such as pins or claps 101P to control the width of the pile surface structure as it is advanced therethrough. A windup device 102 collects the finished product from the device 101.

The finished pile surface structure collected by the windup device 102 is accorded the reference character 112F to distinguish it from the pile surface structure product 112 produced at the output of the stitching apparatus 110. Tension-control devices, such as nip rollers 103A, 103B, are respectively disposed upstream and downstream of the finishing device 101. The nip rollers 103A, 103B, together with the pins 101P, serve to control the longitudinal and transverse tension on the pile surface structure 112. The various other components of the system 100 visible in FIG. 5 will be identified in the context of the following discussion.

If the binder is applied in a liquid form an applicator, exemplified by a roll 106, is located adjacent to (i.e., immediately downstream of) the stitching apparatus 110. Other suitable applicators may include sprayers, doctor blades, and foamers.

Figure 6A:
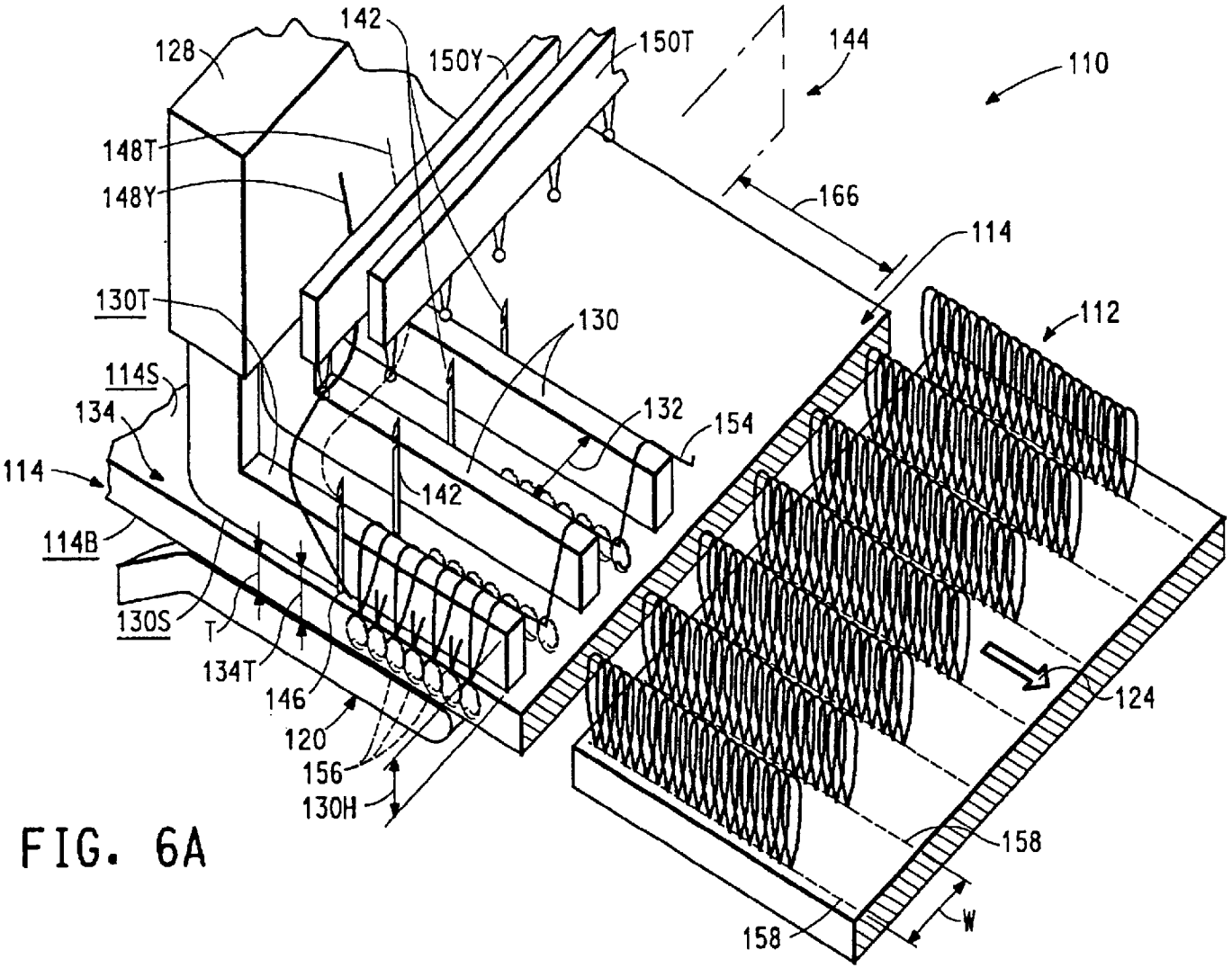
FIG. 6A is a stylized perspective view of an apparatus for producing a laid-in stitch-bonded pile surface structure in accordance with the present invention.

FIG. 6A is a stylized perspective view of the basic embodiment of the stitching apparatus 110. The stitching apparatus 110 shown in FIG. 6A is an amalgamation of certain structural and functional features found in the prior art stitching apparatus 10 and 10", respectively shown in FIGS. 1A and 3A, but which includes modifications in certain areas to produce the pile surface structure 112 of the present invention. Accordingly, where appropriate throughout this discussion of the present invention, structural and functional elements and/or relationships of the stitching apparatus 110 that are similar to elements and relationships in the apparatus discussed earlier will be indicated by reference numerals beginning with the digit "1" followed by the appropriate corresponding basic two-digit reference numeral earlier used to identify the similar element or relationship. In addition, where appropriate, structural and functional elements and/or relationships present in the pile surface structure 112 of the present invention that are similar to elements and relationships found in structures discussed in connection with earlier FIGS. 1A through 3A will be numbered using the same convention. Newly introduced structural or functional elements or relationships found in both the apparatus and the pile surface structure will be indicated by a reference numeral that should have no counterpart in the previous Figures.

The stitching apparatus 110 preferably includes a slotted platen 120 that supports a backing 114 as the same is incrementally advanced along a generally planar path of travel extending longitudinally in the machine direction 124 through the apparatus 100. The path of travel through the stitching apparatus 110 is again arbitrarily shown as a horizontal path. The backing 114 is supplied to the stitching apparatus 110 from a supply roll 104 (FIG. 5).

As a general proposition the backing 114 is preferably a pre-fabricated member, that is formed prior to its insertion into the apparatus 110. The pre-fabricated backing 114 is made of a material that is dimensionally stable in both its longitudinal (warp) and transverse (weft) directions. The backing 114 has a first, top, surface 114S and a second, bottom, surface 114B, and a basic thickness dimension T. The basic thickness dimension T is measured with substantially no applied pressure to the backing 114. Preferred materials for a pre-fabricated backing include any dimensionally stable sheet material onto which a stitch can be attached without tearing or deforming the backing. Knits, nonwovens, films, woven filament fabrics, woven split film sheets, or any stabilized fibrous sheet are suitable. The backing must have sufficient dimensional stability and sufficient resistance to out-of-plane deflection to avoid deformation during feeding and to resist excessive upward deflection as the needles penetrate it and as the loops pull it after formation. Bonded-staple or continuous-filament nonwovens with a weight range between thirty (30) and one hundred twenty (120) gms/sq.m. are preferred. The material of preference is polyester because it is believed to offer the best balance of dimensional stability vs. temperature, moisture, and cost.

However, as will be developed, in some implementations the backing 114 may be formed in-situ by the apparatus 110 simultaneously with the formation of the pile surface structure. Such a backing could be formed using an array of weft-extending yarns, similar to the structure of FIG. 3A.

A sinker bar 128 extends transversely across the stitching apparatus 110. A plurality of sinker fingers 130 extends forwardly from the sinker bar 128 in the machine direction 124. The top surface of each sinker finger 130 is indicated by the character 130T, while the undersurface of a finger 130 is indicated by the character 130S. The top surface 130T of each finger 130 is preferably smooth and polished to facilitate yarn movement and the formation of pile loops, as will be described. A rounded-corner cross-section at the edges of the top surface 130T is preferred. The upper surface 120S of the platen 120 and the undersurface 130S of each of the sinker fingers 130 defines a throat 134 into which the backing 114 is introduced into the stitching apparatus 110.

The sinker fingers 130 are transversely sized or configured, at least in the vicinity of their base region 130B, such that a predetermined close lateral spacing 132 (FIG. 6C) is defined between adjacent fingers 130. In the embodiment illustrated each finger 130 flares at its base 130 toward each adjacent finger. It should be appreciated, alternatively, that a finger 130 may be configured to exhibit the same transverse dimension throughout its height.

Figure 6B:
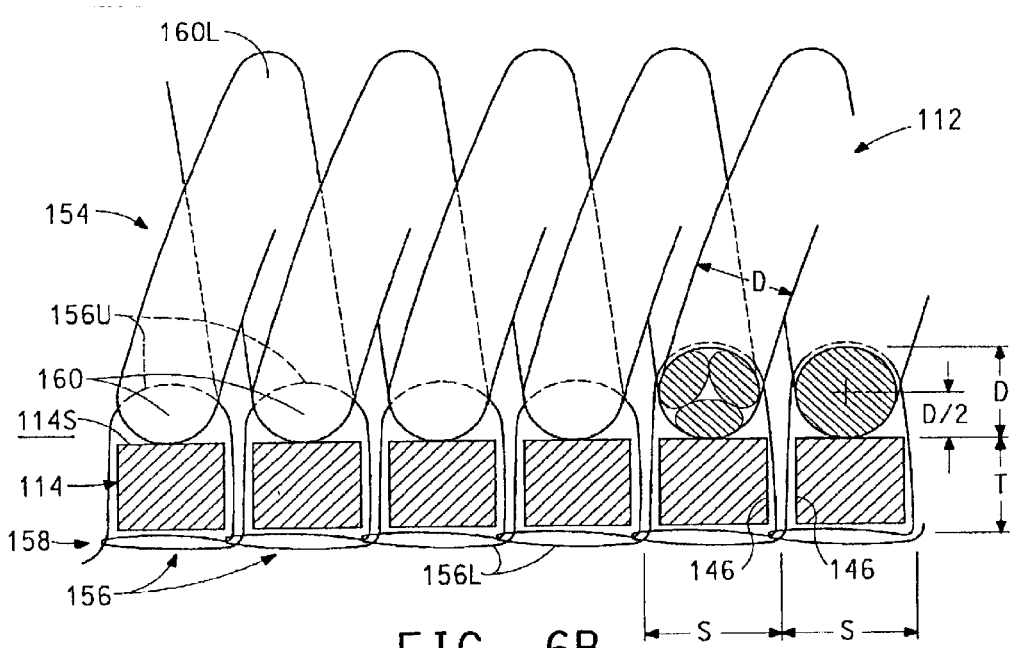
FIGS. 6B and 6C are side and front elevational views, respectively, of the laid-in stitch-bonded pile surface structure produced by the apparatus of FIG. 6A.

A needle bar (not shown) having a plurality of hooked penetrating needles 142 thereon is mounted beneath the platen 120. The needles are transversely spaced by the stitch spacing distance W. Each needle 142 has a predetermined width dimension 142D. The needles 142 extend upwardly through the platen 120. The needles 142 are displaceable in vertically reciprocating fashion in a needle plane 144. The transverse line of needle penetration points 146 lies in the needle plane 144. Each of the reciprocating needles 142 intersects and penetrates the backing 114 at a respective needle penetration point 146 located transversely between the sinker fingers 130 (i.e., in the spacing 132 defined laterally between adjacent fingers). In the pile surface structure 112 each stitch has a "stitch length" indicated by the reference character "S" (FIG. 6B). The "stitch length" denotes the distance between longitudinally successive needle penetration points 146 in any given stitch line 158.

Figure 6C:
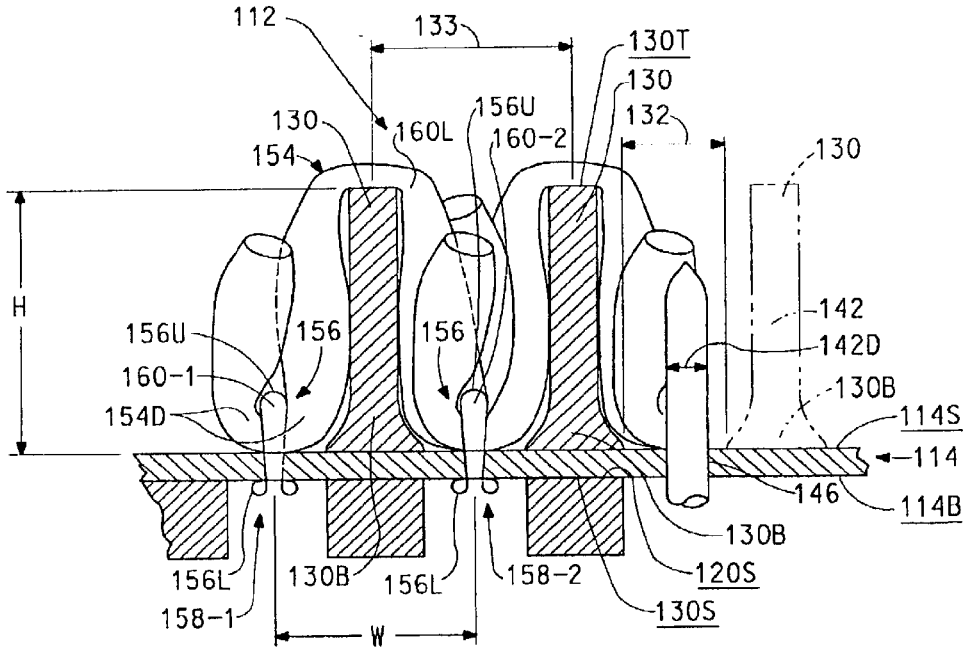

As is perhaps best illustrated in FIG. 6C the lateral spacing 132 between adjacent fingers 130 is sized to permit only the needle 142 and the stitching threads drawn by that needle to pass relatively freely in the vertical direction. The close spacing 132 of adjacent fingers 130 has the beneficial advantage of preventing upward deflection of the backing 114 as the needle 142 moves upwardly through the same. The transverse spacing 132 is about 1.2 to about 1.5 times the width dimension 142D of the needle 142. Preferably, the transverse spacing 132 should not be greater than about 1.5 times the width dimension 142D, and more preferably, not greater than 1.3 times the width dimension 142D.

Guide bars 150T, 150Y are mounted above the sinker fingers 130 and above the planar path of travel of the backing 114. Guide elements 152Y on the guide bar 150Y serve to carry the pile yarns 148Y that are laid into the top surface 114S of the backing 114, while the guide elements 152T on the guide bar 150T carry the stitching threads 148T that hold the pile elements 154 formed by the yarns 148Y to the top surface 114S of the backing 114. The supply creel for the pile yarns 148Y supplied to the guide bar 150Y is indicated in FIG. 5 by the reference character 105Y. The pile yarns may alternatively be supplied to the apparatus 110 from a beam 105Y'.

The pile yarns 148Y used to form the pile elements 154 of the present invention are multi-filamentary single-end yarns that have a diameter generally indicated by the reference character "D", as measured in the free (non-compressed, non-stretched) state. Alternatively, a multi-end yarn formed as a combination of several multi-filamentary single-end yarns may be used as the pile yarn 148Y. The "effective diameter" of the multi-end yarn is also indicated by the reference character "D". The "effective diameter" of the multi-end yarn is also the diameter as measured in its free (non-compressed, non-stretched) state.

A very wide selection of yarns may be used for the pile yarns 148Y, depending upon use and need. Preferred pile yarns are higher-melting temperature yarns such as aramid, nylon or polyester yarn. Heavy and bulky yarns, whether single-end yarn or as multi-end yarn, having a denier in the range from about five hundred to about ten thousand dtex (500–10,000 dtex) are suitable for carpets. Finer yarns, having a denier in the range from about two hundred to about one thousand dtex (200–1,000 dtex) are more suitable for velour fabrics. If a multi-end yarn is used the diameter D refers to the "effective diameter" of the multi-end yarn. For coverage considerations the diameter (or effective diameter) D of the pile yarn should be the same or slightly larger than the stitch length S. Heavier or multi-end yarns provide proportionally higher surface coverage, allowing the use of lower stitching densities, and higher stitching speeds.

For the pile surface structure 112 the total pile yarn weight ("G") ranges from approximately one hundred to twenty-five hundred (100 to 2,500) grams per square meter. One of the fundamental practical advantages of the present invention is that it allows the formation of pile surface structures with very low pile yarn weight and good face coverage of the backing.

It should be appreciated that although only a single guide bar 148Y is shown in the Figures, pile-forming yarns may originate from more than one guide bar, and may have any suitable pattern to create special aesthetics. Yarn tension and yarn consumption may be varied from bar to bar (and from yarn to yarn within the bar), even if all bars use the same or identical-but-opposing stitch pattern. The denier and/or tension of yarns in different bars or wales may also be different, creating a "sculpted" effect.

The stitching thread 148T is normally supplied to the guide bar 150T from a supply beam 105T (FIG. 5). The stitching thread 148T is, in the general case, preferably made of a high-tenacity, fully-set moisture and temperature-stable thermoplastic material. Generally speaking, the denier of the stitching thread 148T is less than one-half the denier of the pile yarns. Preferably, the stitching thread has a denier less than about one-third (⅓) the denier of the pile yarn. Thus, the stitching thread has a denier in the range from about one hundred to about one thousand dtex (100–1,000 dtex). Generally speaking, the material of choice is polyester. Partially oriented shrinkable thermoplastic threads can also be used to advantage, as will be explained hereafter.

In the apparatus 110 the sinker fingers 130 are elongated members sized to extend in the direction of travel 124 forwardly beyond the line of needle penetration points 146 for a predetermined distance 166. As will be more fully developed herein the distance 166 is on the order of five (5) to twenty-five (25) mm. In terms of stitch lengths S (FIG. 6B) the distance 166 should preferably be a minimum of two stitch lengths.

At least that portion of the length of a given finger 130 that extends for the distance 166 past the needle penetration points 146 exhibits a predetermined substantially uniform height dimension 130H. The height dimension 130H of a given finger 130 is measured between the apex of its top surface 130T and its undersurface 130S. In practice, the entire length of the finger, from sinker bar 128 to end 130E, exhibits the height dimension 130H. A uniform height dimension of a finger 130 past the needle penetration points 146 helps to balance the pile yarn feed on each pile loop formed over that finger and prevents pile yarn pull-back as subsequent stitches are formed. In the Figures laterally adjacent fingers have been illustrated as being of equal heights. However, it should be understood that the pile-forming fingers may have varying heights (so long as any given finger meets the uniform height limitation discussed above), whereby pile loops formed over the adjacent fingers creates a pile surface structure with a "high-low" striped effect.

Improved pile coverage is formed when the height 130H of the finger 130 is at least one-half the transverse distance 133 (FIG. 6C) between the centers of adjacent fingers 130. Even better cover is achieved when the height 130H is at least equal to the transverse distance 133. The highest level of coverage is achieved when the height 130H is at least twice the transverse distance 133.

Figure 6D:
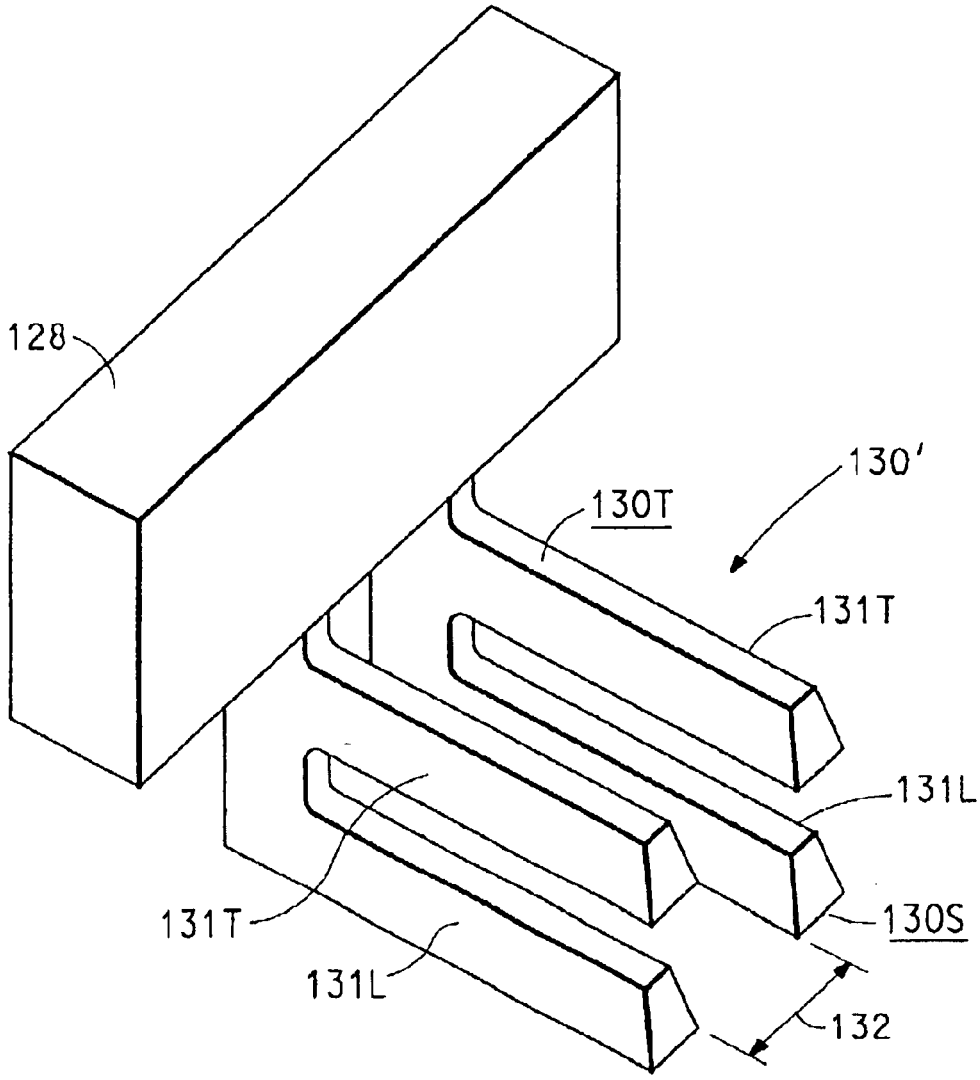
FIG. 6D is a perspective view of an alternate form of sinker finger used in the apparatus in accordance with the present invention.

The preferred form of sinker finger 130 is formed as a solid, uninterrupted member, as illustrated in FIG. 6A. Alternatively, as is shown in FIG. 6D, the sinker finger 130' may be configured as a fork-like structure having an upper tine 131T and a lower tine 131L. The top surface of the upper tine 131T defines the upper surface 130T of the finger 130, while the bottom surface of the lower tine 131L defines the undersurface 130S of the sinker finger 130. The tines may be vertically adjustable. For example the lower tine 131L may be fixed and the upper tine 131T vertically moveable to adjust the height of the pile formed.

The operation of the stitching apparatus 110 is substantially identical to the operation of the apparatus 10 (FIG. 1A). The backing 114 is introduced into the throat 134 defined between the platen 120 and the undersurface 130S of the sinker fingers 130. Again, the bottom surface 114B of the backing 114 is supported on the platen 120 while the top surface 114S is presented to the undersurface 130S of the sinker fingers 130. However, in accordance with the present invention, the dimension 134T of the throat 134 is sized to be substantially equal to the thickness dimension T of the backing 112. The backing 114 is relatively closely confined between undersurface 130S of the sinker fingers 130 and the platen 120 as the backing 114 is advanced in the machine direction 124 through the stitching apparatus 110. As a result the backing is held in place at a set distance (equal to the height 130H) from the top of the sinker fingers, thereby to control the height of the pile loop elements. Such close confinement avoids vertical displacement of the backing 114 as it is reciprocally penetrated by the needles, thus avoiding the loosening of chain stitch underlaps. Owing to the extent of the sinker fingers 130 in the machine direction 124 past the needle penetration points 146, relatively close confinement of the backing 112 between the surface 130S and the surface 120S of the platen 120 continues as the backing 114 is advanced though the stitching apparatus 110.

Stitching threads 148T from adjacent first and second thread guides 152 on the thread guide bar 150T are successively looped around respective first and second locations on a length of pile yarn 148Y dispensed from the guide 152 on the yarn guide bar 150Y, in a manner similar to the action as earlier described in connection with FIG. 1A. However, similar to the situation depicted in FIG. 3A, owing to the extension of the elevated sinker fingers 130 forwardly past needle penetration points 146 (for the distance 166), as adjacent first and second needles respectively engage the looped first and second stitching threads and draw these threads downwardly toward the backing 114, the pile yarn 148Y becomes trained over the surface 130T of the sinker finger 130, thereby forming a laid-in pile yarn element 154 overlying above the first surface 114 of the backing 112. A reciprocating 0-0/2-2 motion of the guide bar may be used. Similar to the apparatus of FIG. 1A, "Laid Atlas" stitches using 0-0/2-2/2-2/4-4/4-4/6-6/6-6/4-4/4-4/2-2/2-2/0-0 motions, or stitches with even wider transverse movements, such as 0-0/3-3, repeating or propagating in various "Atlas" patterns, may also be used to create various patterns or surface effects.

The formation of the plural rows of pile elements 154, the formation of chain stitches 156 having underlaps 156U holding transverse ends of the laid-in pile yarn elements 154, the formation of longitudinally extending overlap portions 156L on the bottom surface 114B of the backing 114, and the formation of longitudinally extending parallel lines 158 of chain stitches 156 with the stitch spacing ("wale") W, are also all identical to the corresponding operations described in connection with the apparatus of FIG. 1A.

As is best illustrated in the side and front elevational views of FIGS. 6B and 6C the pile yarn element 154 so produced has the form of a pile loop that overlies the top surface 114S between a first generally U-shaped root portion 160-1 located in a first longitudinally extending stitch line 158-1 and a second generally U-shaped root portion 160-2 located in a second longitudinally extending stitch line 158-2. Each root portion 160 is held against the top surface 114S of the backing 114 by the underlap portion 156U of one of the stitches 156. The inverted loop portion 160L of the pile yarn element 154 stands substantially erectly over the surface 114S. The loop portion 160L extends above the top surface 114S of the backing 114 for a predetermined erect pile height distance H. The pile height distance H is measured between the top surface 114S of the backing 114 and the inside surface of the loop portion 160L of the pile yarn element 154. Owing to the very close lateral spacing 132 between adjacent fingers 130, deflection of the backing 114 during the upward stroke of the needle 146 is held to a minimum. In addition, the substantially uniform height dimension 130H of the fingers 130 (for at least the distance 166 past the needle penetration points 146) prevents pull-back of the pile element as subsequent stitches are formed. These two considerations, coupled with fact that the dimension 134T of the throat 134 is substantially equal to the thickness dimension T of the backing 114, result in a looped pile element 154 having a height dimension H that is substantially equal to the height dimension 130H of the sinker fingers 130. Typically the height dimension H of the loop pile element 154 is on the order of one to twenty (1–20) millimeters. In a pile surface structure 112 formed in accordance with the present invention the ratio of the predetermined pile height H to the predetermined stitch spacing W preferably satisfies the relationship:

$$H/W>0.5 \quad (1).$$

As noted earlier each stitch 156 includes an underlap portion 156U that extends over the top surface 114T of the backing 114 and a looped overlap portion 156L that extends over the bottom surface 114B of the backing 114. The overlap portions 156L interlink, chain fashion, with the loop of the previous stitch. A stitch 156 in the form of a closed 1-0/1-0 chain stitch is preferred, although other stitches, such as an open 1-0/0-1 stitch, can be used.

Recognizing that the backing 114 has a thickness dimension T, the pile yarn 148Y (whether single or multi-ended) has a diameter (or effective diameter) D, and the overlap portion 156L has a predetermined length dimension substantially equal to the stitch length S, it may be appreciated from FIG. 6B that all or substantially all of the stitches 156 have a theoretical thread deknit length DKL given by the relationship:

$$DKL<=D\cdot(1+\pi/2)+(2\cdot T)+(2\cdot S) \quad (2).$$

The theoretical thread deknit length DKL represents the length of stitching thread utilized to form a given stitch 156. If that stitch were unraveled the maximum length of thread used in that stitch would be given by Equation (2).

The last term [(2·S)] of the theoretical thread deknit length Equation (2) represents the length of the chain stitch overlaps 156L. Because of interlooping between longitudinally adjacent overlaps, the actual length is slightly longer than the length expression used in Equation (2). The middle term [(2·T)] of Equation (2) represents the length of thread segments entering and leaving the backing. These segments are usually small and difficult to change since most backings are relatively thin and incompressible.

The first term [D·(1+π/2)] of the theoretical thread deknit length Equation (2) represents the length of the chain stitch underlaps 156U holding the U-shaped root portions of the pile yarn elements to the backing 114. As will be discussed, this length can be reduced by either applying higher tensions to the thread during stitching, by shrinking the thread after stitching, or by stitching the backing and causing some of the thread length of the underlaps to be pulled tighter.

To reduce the first term [D·(1+π/2)] of Equation (2) and tighten the underlaps so that the pile yarn in the root portions of the pile elements is compressed to approximately half of its diameter, it was estimated that DKL should be reduced by about ten (10%) percent. Accordingly, more preferably, in accordance with the present invention the theoretical thread deknit length DKL for all or substantially all of the stitches 156 is given by the relationship:

$$DKL<=0.9\cdot[D\cdot(1+\pi/2)+(2\cdot T)+(2\cdot S)] \quad (2A)$$

Even more preferably the theoretical thread deknit length DKL for all or substantially all of the stitches 156 is given by the relationship:

$$DKL<=0.8\cdot[D\cdot(1+\pi/2)+(2\cdot T)+(2\cdot S)] \quad (2B)$$

The theoretical thread deknit length DKL given by the Equation (2B) corresponds to a reduction of pile yarn diameter to approximately one-fifth of its basic diameter (or effective diameter) D. In most cases such a reduction corresponds to a yarn which is compressed to such an extent that the filaments forming the yarn are nearly solidified when viewed in cross section.

In practice, the actual thread length is automatically recorded in terms of "runners". A "runner" is the length of thread consumed in forming four hundred eighty (480) stitches. The actual DKL for each stitch formed may be calculated (runner thread length/480) and compared to the theoretical value given by Equations (2A), (2B), or (2C).

A pile surface structure 112 in accordance with the present invention, having stitches 156 with a deknit length DKL that is smaller than the value given by Equation (2), is defined as a "tight" structure. That is to say, the underlaps 156U of the stitches 156 holding the looped pile yarn element 154 to the backing would, in the root portion 160 of the element, constrict or squeeze the pile yarn into tight contact with the backing 114. The constriction, or squeezing, of the yarn by the underlap 156U forms distended regions 154D in the root portion 160 of the pile element 154.

The chain stitches may be tightened by increasing the stitch length S without simultaneously decreasing the deknit length DKL, and particularly by modifying the length represented by the first term of Equation (2). Tightening the chain stitches 156 more tightly squeezes and constricts the U-shaped root portions 160 of the looped pile elements 154, enlarging the distended regions 154D on each side of the underlap 156U and thereby increasing pile-loop pull-out resistance.

One expedient to enhance stitch tightness is to apply high tension to the thread 148T during production of the pile surface structure 112.

A second expedient to enhance stitch tightness is to stretch the pile surface structure 112, thus increasing the dimension S without stretching the stitching thread, causing the underlaps 156U to tighten around the root portions 160 of the pile yarn elements 154. A longitudinal stretch of only a few percent is effective to tighten the stitches. The pile surface structure 112 should be stretched in the longitudinal direction by at least two (2%) percent to cause the further tightening of the chain stitches around the roots of the pile yarns. Preferably, the pile surface structure 112 is stretched longitudinally in the range from about two percent to about twenty percent (2–20%). More preferably, the backing is stretched longitudinally in the range from about five to about fifteen percent (5–15%) causing the chain stitches 156 to severely tighten around the backing and the root portion 160 of the pile elements 154. Any suitable devices can be used to effect the stretching, such as nip rolls 103A, 103B (FIG. 5), disposed between the stitch bonding stitching apparatus 110 and the final wind-up 102.

To facilitate stretching of a stitched pile surface structure 112 having a pre-fabricated backing, the backing 114 should be stretchable. A stretchable backing may be formed from partially oriented fibers that do not stretch with the application of a low tensile force (such as the force required to perform the stitching operation) but will elongate when a predetermined tensile force threshold is applied at room temperature. When the backing 114 is stretchable at room temperature, the stretching force is applied in the absence of heat. Accordingly, in this instance the finishing device 101 may be omitted from the system 100. However, it is advisable to use the device 101 to "heat-set" the pile surface structure 112, usually by heating to the heat setting temperature required by the material for thirty to sixty (30–60) seconds and cooling under restraint. A closed 1-0/1-0 chain stitch is preferred if this mode of tightening is used.

An alternative stretchable backing 114 may be fabricated from a bonded material that is dimensionally stable during the formation of the pile elements thereon, but having bonds that become soft and stretchable in the presence of heat. Examples include spun-bonded nonwovens using a high melting/low melting backing material manufactured by Reemay Inc., Old Hickory, Tenn. and sold under the trademark Reemay®. When the backing is so softened, the application of a longitudinally directed force causes the backing to stretch, thereby increasing the stitch length S and correspondingly tightening the stitches. The material should exhibit a temperature profile that imparts sufficient stretchability at a temperature that does not affect the integrity of the pile yarns or the integrity of the stitching thread.

To practice this stretch-tightening expedient, the pile surface structure 112 is produced on the backing 114 in the stitching apparatus 110 as described. Thereafter, the structure 112 is advanced through the device 101. A longitudinal stretching force may be imposed on the pile surface structure 112 (either while within the device 101 or upon removal therefrom) to cause the backing 114 to deform. For the preferred polyester backing heating the pile surface structure 112 to a temperature in the range one hundred eighty to two hundred ten (180–210) degrees C. applied for thirty to sixty (30–60) seconds, followed by cooling under restraint by the nip rolls 103A, 103B described, is recommended.

If the backing 114 is formed in-situ from weft-extending yarns, the pile surface structure 112 offers virtually no resistance to stretching. In this case the pile surface structure 112 is stretched in the device 101 without applying heat.

Perhaps a more effective route to shorten stitch length and tighten the chain stitches is to use a stitching thread 148T that shrinks permanently with the application of heat. Most high-tenacity polyester threads and other polyester, nylon or polypropylene threads will shrink sufficiently, for example, on the order of about five percent to about thirty percent (5%–30%) of its original length, when exposed to the temperature range of one hundred ten to two hundred ten (110–210) degrees C. Thread made of a partially oriented thermoplastic material shrinkable to at least ninety percent (90%), or in some cases to as little as forth to fifty percent (40%–50%), of its original length can also be used with particular success. It is believed necessary to heat-set such threads (e.g., at two hundred ten (210) degrees C. for thirty seconds for polyester threads) in situ, under restraint after shrinking to achieve the best overall results. Restraint in the longitudinal direction may be achieved by the nip rolls 103A, 103B, while restraint in the transverse direction may require an appropriate pin holding device 10P.

After production of the pile surface structure 112 by the stitching apparatus 110, the pile surface structure 112 is advanced into the finishing device 101 (FIG. 5). The nip roll devices 103A, 103B and pin holding device 101P aid in regulating longitudinal stretch or shrinkage under heat. A practical indicator of a high level of stitch tightness produced via stitching thread shrinkage is the onset of a buckled or puckered appearance of the backing caused by the shrinkage of the chain stitches. Buckling of the backing usually indicates that maximum tightness of the chain stitches has been achieved.

After tightening of the stitches is completed, by use of any of the above-discussed alternatives, the finished pile surface structure 112F is collected by the wind-up 102.

The use of binder material within the pile surface structure 112, 112F is an important aspect of the present invention. As used throughout this application, including the claims, the term "within the pile surface structure" means that portion of the pile surface structure 112, 112F between the top of a pile element 154 (whether loop or cut pile) and the second (lower) surface 114B of the backing 114. The presence of binder material further enhances the stability of the backing 114 and the pile yarn elements 154 produced thereon.

Thermoplastic or thermoset binder materials may be used. Suitable thermoplastic binder materials include low melting-polymers such as polyolefins, co-polymers of polyester or polyamides. By "low melting" it is meant that the material melts at a temperature approximately twenty-five (25) degrees C. lower than the melting temperature of the pile yarns, stitching threads and backing (or any other materials present in the pile surface structure 112, 112F). Suitable thermoset binder materials include styrene-butylene resin (SBR) latex formulations, which usually include various fillers, such as clay. Elastomeric latex formulations can also be used in case where flexibility is required.

Figure 6E:
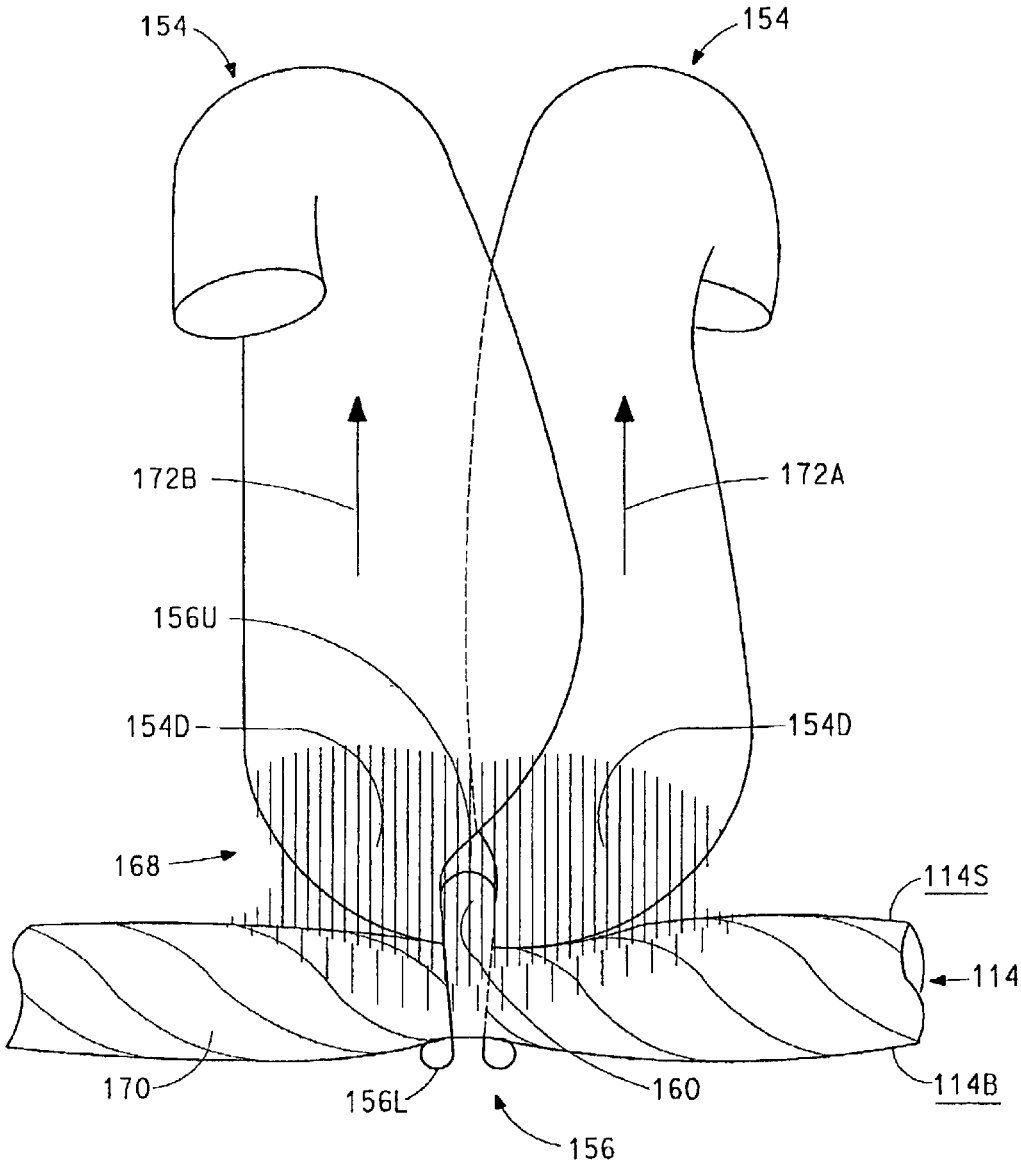
FIG. 6E is an enlarged front elevational view of the pile surface structure in accordance with the present invention showing the root portion of a pile yarn element having a binder material disposed thereon.

The precise location of the mass of binder material within the pile surface structure 112, 112F is important. The presence of a binder material in the distended regions 154D formed by the constricting underlap 156U dramatically increases the pull-out resistance of the pile yarn element 154. "Pull-out resistance" is that upward force which, when applied to a pile element, is sufficient to raise that pile element permanently above the other pile elements. In FIG. 6E the binder material is represented by the shaded areas 168. A relatively small amount of binder material is needed in the locations 168 when the chain stitch 156 is tight, i.e., it satisfies the deknit length Equations (2), (2A), (2B). If the total weight of the yarn used to form the pile yarn elements 154 is G grams, then preferably the weight of the binder material 168 within the pile surface structure is less than G grams, but more preferably, less than [(⅔)·G], and most preferably less than [(½)·G]. An even smaller amount of binder material in the locations 168 is needed when the chain stitch 156 has been shrunk to the point where buckling of the backing 114 is achieved.

As may be appreciated from FIG. 6E the major portion of the binder material within the pile surface structure is concentrated above the backing in the vicinity of the U-shaped root portions 160 of the pile elements 154 surrounding the underlaps 156U that hold the pile element to the top surface 114S of the backing 114. As represented in FIG. 6E at 170 some binder material is also present in the backing 114.

More particularly, the binder material is concentrated:

(1) in the distended regions 154D of the pile element formed by the constricting underlaps 156U (Region 1);

(2) in the constricted root 160 (Region 2);

(3) in the thread forming the underlaps 156U (Region 3);

(4) in the space between distended regions 154D (Region 4);

(5) in the space between distended regions 154D and the first surface 114S of the backing 114 (Region 5); and (6) near the upper surface 114S of the backing 114 adjacent to the roots 160 of the pile elements 154 (Region 6). It is noted that some binder material may be incidentally present in regions of the backing spaced from the roots.

Substantially all of the filaments of the pile yarn in the distended regions 154D of the root portions of substantially all of the pile elements have binder material present thereon. At least the upper two-thirds of the pile yarn element 154 remain substantially free of binder material.

The presence of a mass of heat-activated binder material (i.e., solidified thermoplastic binder or cured thermoset binder) in the distended regions 154D of the pile elements 154 imparts a very high pull-out resistance against forces imposed axially on the branches of the roots in the direction of the arrows 172A, 172B. Stated alternatively, the distention of pile yarn created by the constricting underlap 156U, together with the presence of the solidified or cured binder material, places masses of material at each side of the underlap 156U which makes pull-out of the pile yarn element 154 practically impossible without breaking the stitching thread.

The thermoplastic or thermosetting binder material may be applied in a variety of fashions.

Figure 6F:
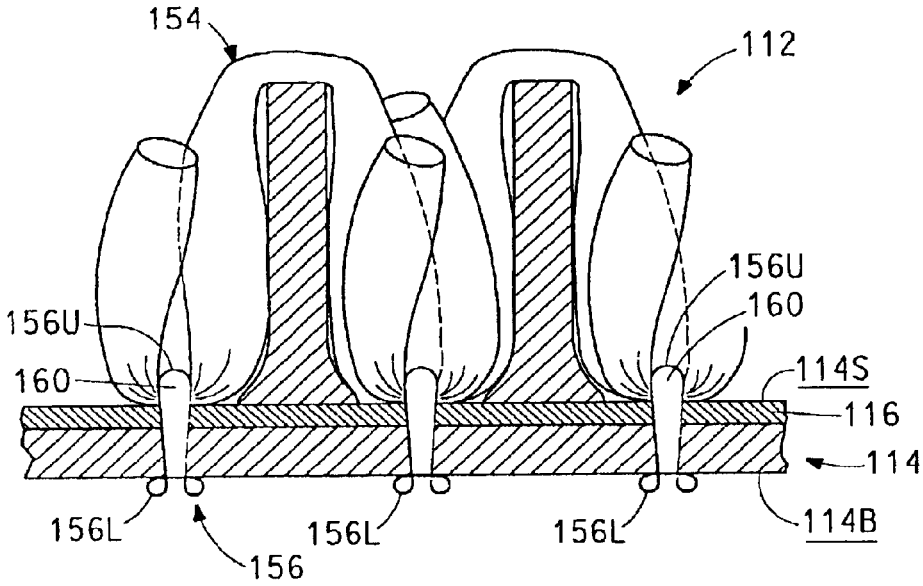
FIG. 6F is a front elevational view illustrating a pile surface structure in accordance with the present invention wherein the backing has a layer of binder material disposed thereon.

In one instance, seen in FIG. 6F, the backing 114 may have a layer 116 of solid thermoplastic binder material thereon. The layer 116 of binder material may be implemented using a fusible adhesive film or fusible fibrous fabric disposed between the top surface 114S of the backing 114 and the underlaps 156U. Polypropylene or polyethylene films and nonwovens are suitable as binder sheets if combined with higher-melting backings and pile yarns such as polyester and nylon. The layer 116 may also be in the form of a pre-coating applied to the top surface 114S of the pre-fabricated backing. When determining the relative weights of the binder material and the pile yarn the weight of the binder material is substantially equal to the weight of the layer 116.

A preferred version of a thermoplastic binder layer is a low-melting temperature sheet that shrinks substantially as it softens and melts, thereby breaking into stripes of molten binder concentrated on the stitch lines at the roots of the pile yarns. This feature can apply to the pile structure of FIGS. 6E and 6F, as well as any stitched structure using a binder layer. For example, such a sheet may be a film that has been cross-stitched but not highly heat set, or a nonwoven that has randomly laid or cross-laid fibers such as a spun-laced or spun-bonded nonwoven.

To apply the binder material in this form the backing 114 is introduced into the throat 134 of the stitching apparatus 110 with the layer 116 of solid fusible binder material presented to the undersurface 130S of the fingers 130. After production in the manner earlier described the pile surface structure 112 is advanced into the finishing device 101 where the binder layer 116 is activated to bond the pile yarn elements 154 to the underlaps 156U of the chain stitch 156 and to the backing 114, and, most importantly, to achieve the placement of the binder material on substantially all of the filaments in the distended regions 154D of the U-shaped root portions 160 of the pile elements. The activation temperature of the fusible binder material is selected such that bonding of the adhesive does not affect the integrity of the pile yarns or the integrity of the stitching thread. Exposure to heat activates the adhesive material, causing it to flow to the constricted roots of the pile yarns and between the pile yarns and the backing. The finished pile surface structure 112F is collected by the wind-up 102.

As another alternative liquid binder material can be applied through the bottom surface 114B of the formed pile surface structure 112, and thereafter activated. The binder material may be dissolved or dispersed into a liquid carrier. When determining the relative weights of the binder material and the pile yarn, the difference in the dry weight of the pile surface structure after finishing as opposed to the dry weight of the pile surface structure before the application of binder is used to determine the weight of the binder material. The roll applicator 106 (FIG. 5) located immediately downstream of the stitching apparatus 110 is a convenient device for applying the liquid binder to the surface 114B.

Figure 6G:
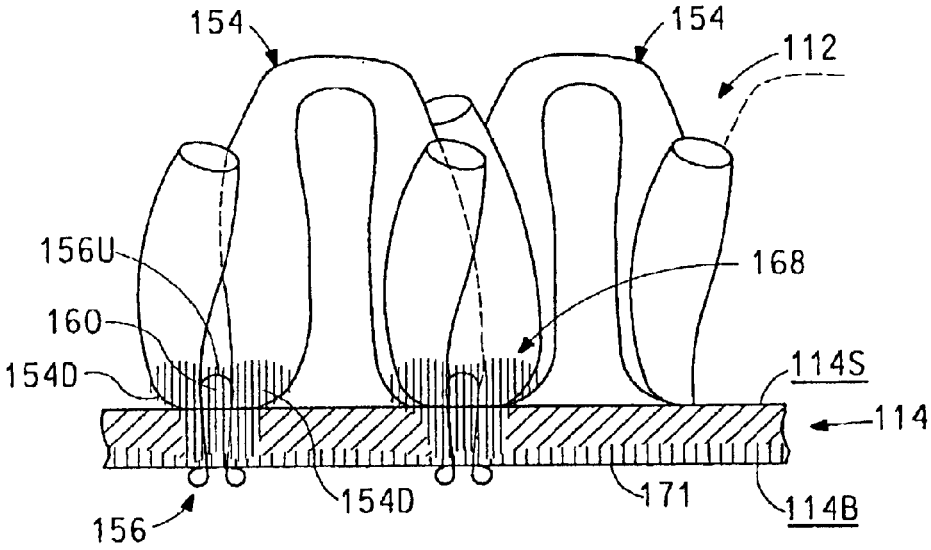
FIG. 6G is a front elevational view illustrating a pile surface structure in accordance with the present invention wherein a binder material has been applied as a liquid layer through the bottom surface of the backing.

It has been found that liquids such as low viscosity latex solutions tend to be absorbed more readily through the needle penetration points and to follow, by capillary action, the stitching thread into the constricted regions at the roots of the pile element. As best seen in FIG. 6G the liquid binder material, because of capillary action, proceeds along the stitching thread to wet the root portions 160 of the pile yarns, and proceeds along the pile yarns into the distended portions 154D at each side of the underlap 156U. As indicated at 171 the relatively thin and dense backing 114 absorbs lesser amounts of the binder material.

As a further refinement the backing 114 can be made from a material that repels the solvent or liquid carrier, minimizing the amount of binder absorbed by the backing. The repellent may be applied to the entire backing, or, more preferably, may treat only the bottom surface 114B thereof.

Figure 6H:
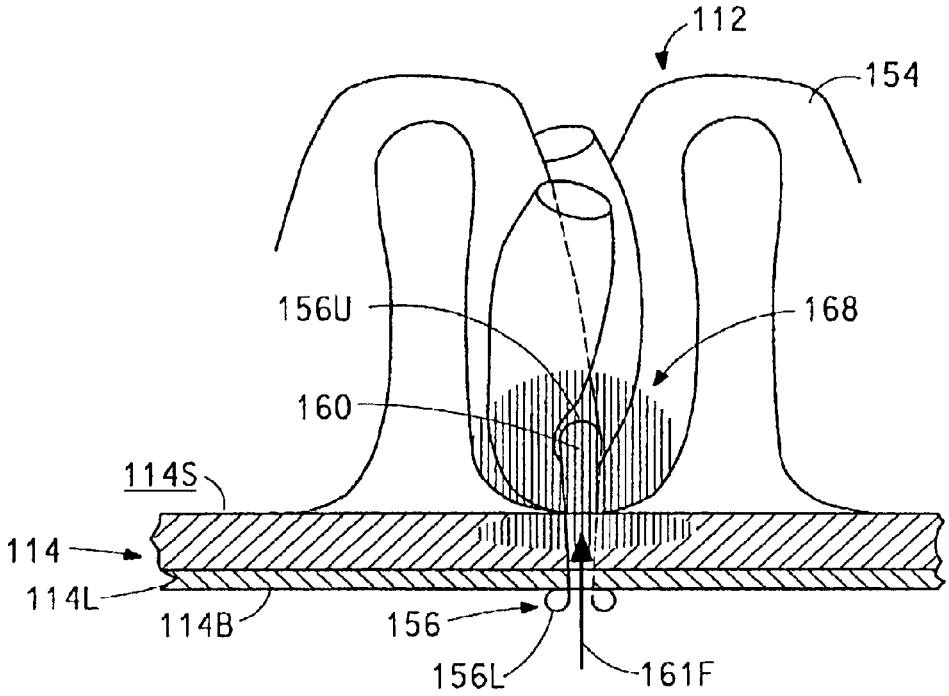
FIG. 6H is a front elevational view similar to FIG. 6G showing a two-layered backing having a layer that is repellent or impermeable to a liquid binder material as the bottom surface of the backing and a layer that is permeable or absorbent to a liquid binder material as the top surface of the backing.
Figure 6I:
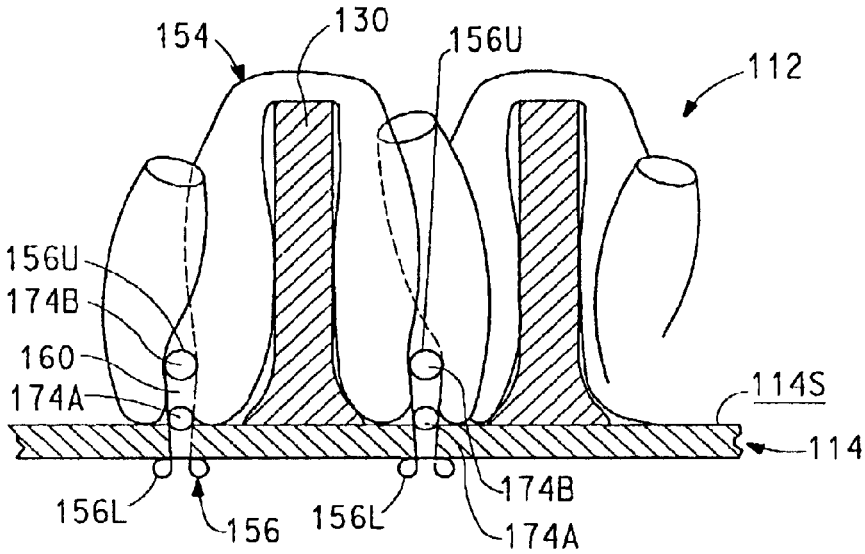
FIGS. 6I and 6J are, respectively, side and front elevational views illustrating a pile surface structure in accordance with the present invention having an array of longitudinally-inserted strands of binder material incorporated therein.
Figure 6J:
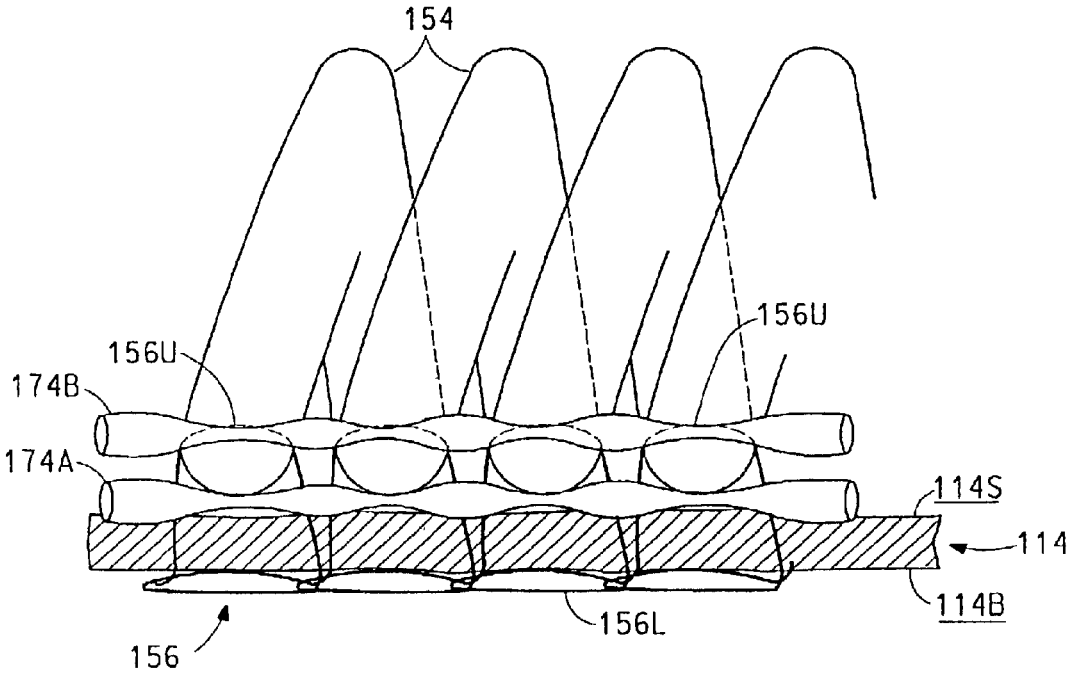

As a still further refinement the backing 114 may be configured as a two layer structure (FIG. 6H) in which the lower layer 114L (forming the bottom surface 114B) is formed of a material that is repellent or even impermeable by to the liquid binder material, while the upper layer 114U is formed of a material that is permeable or even absorbent of the binder material. In FIG. 6H the closely-hatched areas respectively show the denser regions of binder concentration and the route of binder propagation (indicated by the arrow 161F).

After application of the liquid binder material, the pile surface structure 112 is introduced into the finishing device 101 for activation of the binder material. The finished pile surface structure 112F is collected by the wind-up 102.

The binder material may also be added by forming the stitching threads 148T as composites of a low-melting temperature binder material and a higher melting temperature material. The two components of the composite stitching thread 148T may be combined by twisting, air-entangling, or other processes.

In the most preferred instance the binder material originates in the form at least one, but more preferably, two longitudinally extending strands 174A, 174B of solid thermoplastic binder material that is(are) laid-into the pile surface structure 112 during the production thereof. This aspect of the present invention is illustrated in FIGS. 6I, 6J, 6K and 6L. As seen from FIGS. 6I and 6J the first strand 174A of binder material is disposed between the top surface 114S of the backing 114 and the root portion 160 of the pile yarn element 154. A second strand 174B of binder material may be laid over the root portion 160 of the pile yarn element 154. The strand(s) 174A and 174B (if used) are held in place against the root portion 160 by the underlaps 156U of the chain stitch. As is illustrated in FIG. 6M, the binder can also originate in the form of a binder strand 174C extending in the weft direction across the pile surface structure.

A preferred form of low-melting temperature strand is made of a binder material that shrinks, softens and breaks into segments as it melts. Examples of such strands are highly drawn but not relaxed yarns or slit films. This form of strand is useful in the structure of FIGS. 6E, 6I–6M, 8A–8C and 10.

Binder strands 174A, 174B and 174C may comprise a composite of a low melting temperature binder material and a higher melting temperature reinforcing material. Such composite strands can perform the binder concentrating function and a reinforcing function simultaneously.

The denier of the strands 174A, 174B and 174C of binder material can vary, but it is usually of the same order of magnitude as the pile yarns it secures. For most carpet applications, and depending upon whether one or more strands of binder material are used, the denier of the strand(s) varies between a few hundred and a few thousand denier. When determining the relative weights of the binder material and the pile yarn the weight of only the binder material in the strand(s) is used.

The binder portion in the strands 174A, 174B, and 174C can be formed of any material that melts and flows at a temperature well under the melting point of the pile yarns, stitching threads and backing.

Figure 6K:
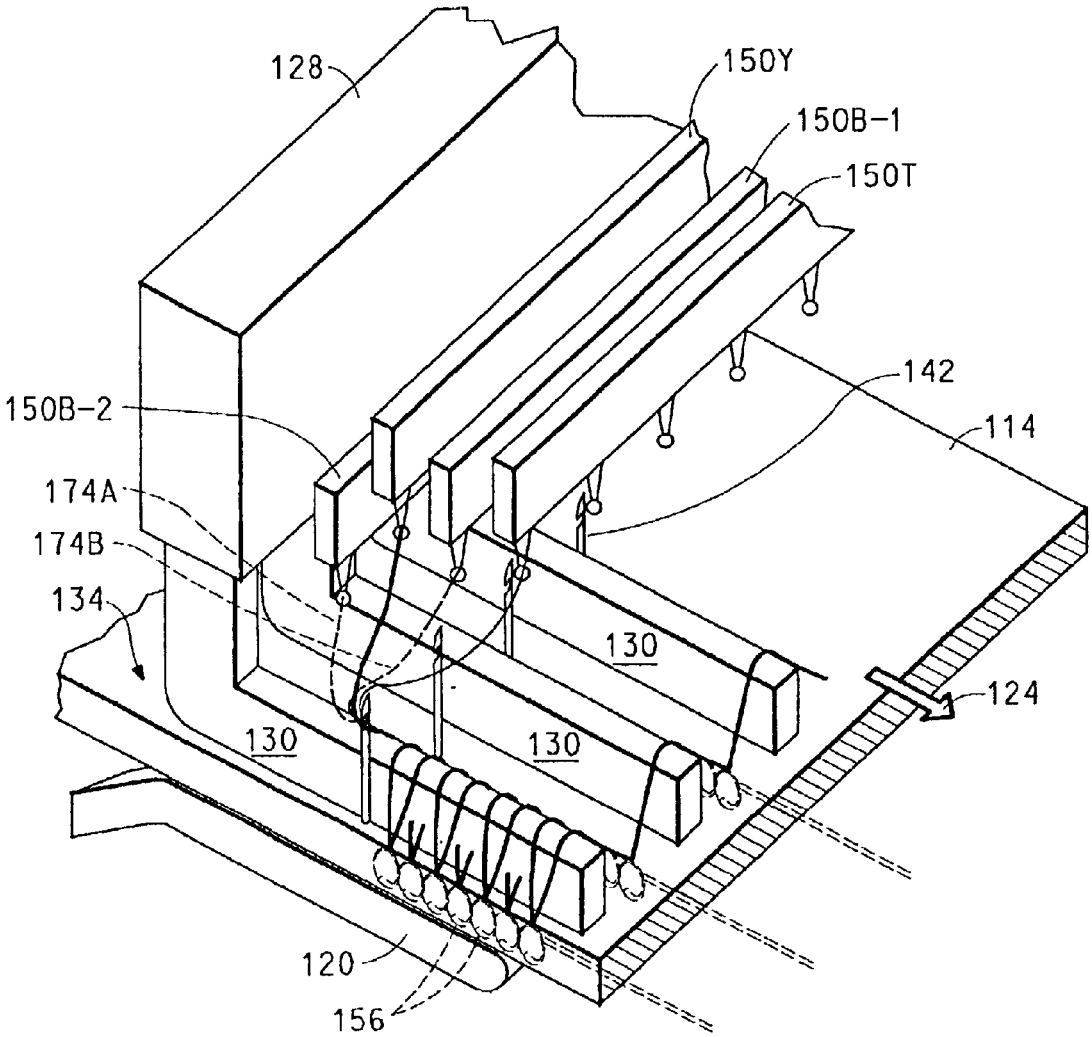
FIG. 6K is a stylized perspective view of a modified stitching apparatus for producing the pile surface structure of FIGS. 6I and 6J.

To produce the pile surface structure having the longitudinal strands 174A, 174B (if used) of binder material therein, the stitching apparatus 110 is modified as shown in FIG. 6K to include an additional guide bar 150B-1, 150B-2 for each longitudinal strand of binder material used. The longitudinal strand(s) of binder material may be deployed with a 0-0/1-1 or 1-1/0-0 stitch. The longitudinal strands 174A, 174B (if used) of binder material is(are) supplied to the respective guide bar 150B-1, 150B-2 from suitable supply rolls 107A, 107B, respectively (FIG. 5). The weft extending binder strands 174C in FIG. 6M can be introduced by weft insertion from dedicated supply rolls usually located to the side of the stitch bonding apparatus 110 (not visible in FIG. 5).

After production the pile surface structure 112 having one, two, or all three of the binder yarns 174A, 174B and 174C therein is advanced into the finishing device 101. Within the finishing device 101 the strand(s) of binder material (is) are heat-activated at a temperature under the softening or melting temperature of all other components. In perhaps the best implementation, as the pile surface structure 112 is advanced through the finishing device 101 the bottom surface 114B of the backing 114 is heated while the stitching thread, and, optionally, the whole structure, are allowed to shrink in the machine direction causing the underlaps of stitching thread to tighten while the strands of binder material melt.

Figure 6L:
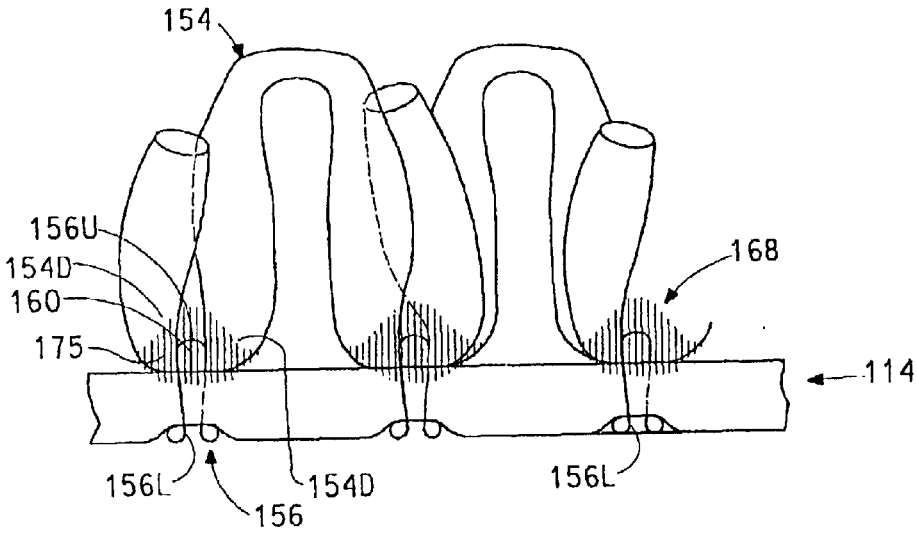
FIG. 6L is a front elevational view illustrating the pile surface structure of FIGS. 6I and 6J wherein the strands of binder material been activated.
Figure 6M:
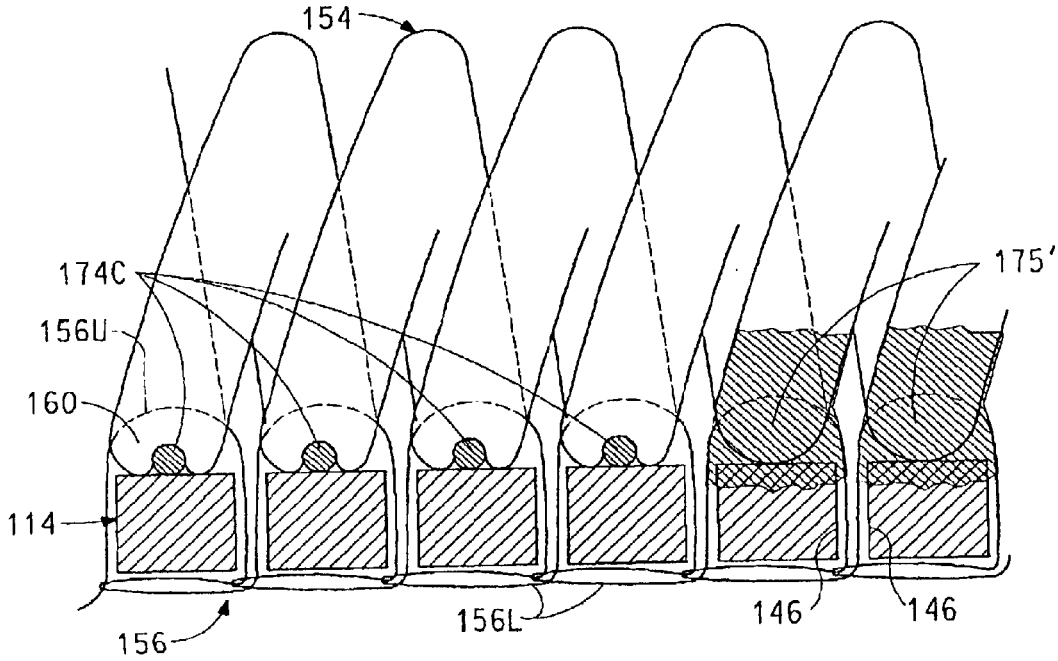
FIG. 6M is a side elevational view illustrating a pile surface structure in accordance with the present invention having an array of weft-extending strands of binder material incorporated therein.

The shaded areas 175 in FIG. 6L show the molten strands 174A, 174B of binder material as "squeezed" into the distended regions 154D of either side of the underlap 156U. The shaded areas 175' in the right-hand portion of FIG. 6M illustrate the seepage of molten binder material from the weft-extending strands 174C into the distended regions 154D of the roots 160 of the pile elements 154. Strong adhesion between molten binder strands and pile yarn (or molten binder strands and stitching thread) is not necessary, because the molten binder strands effectively envelop the root portions 160 of the pile yarn elements, and prevent them from being pulled through the underlaps of the chain stitches, as discussed in connection with FIG. 6E.

After activation of the binder material in the finishing device 101 the finished pile surface structure 112F is collected by the wind-up 102. If the binder material originates in the form of longitudinally extending strands, then in the finished pile surface structure the binder material appears as longitudinally extending, spaced parallel stripes of heat-activated binder material passing through the constricted root portions of the pile elements 154. Similarly, if weft-extending strands 174C of binder material were provided, then spaced parallel stripes of heat activated binder material extending in the weft direction appear in the finished pile surface structure. The longitudinally extending stripes and weft-extending stripes define a matrix array of stripes of heat-activated binder material in the finished pile surface structure.

The longitudinal or weft-extending stripes may be continuous or discontinuous, depending upon the binder material selected. If the preferred form of low-melting temperature binder strand is used the stripes are discontinuous because such strands tend to break into segments that concentrate at the pile roots.

The present invention allows the concentration of binder material in the vicinity of the constricted chain stitch underlaps and therefore, the use of binder at amounts much less than the weight of the pile yarns, compared to the tufted carpet constructions.

It should be noted that the binder should preferably be present at locations adjacent to the root portions of the pile elements before any tightening of the underlaps (as by stretching of the pile surface structure or by shrinkage of the stitching threads) is caused to occur. This condition is automatically met when binder in solid form, i.e., as a binder layer, as a component of the stitching thread, or as binder strands, is used. When a liquid binder is used care must be taken to avoid over-tightening the underlaps before the application of the liquid binder through the backing. Tight underlaps may impede the propagation of liquid binder. During any stretching heat may be added to activate the binder. The heat applied to shrink permanently the stitching threads should be sufficient to also activate the binder.

Figure 6N:
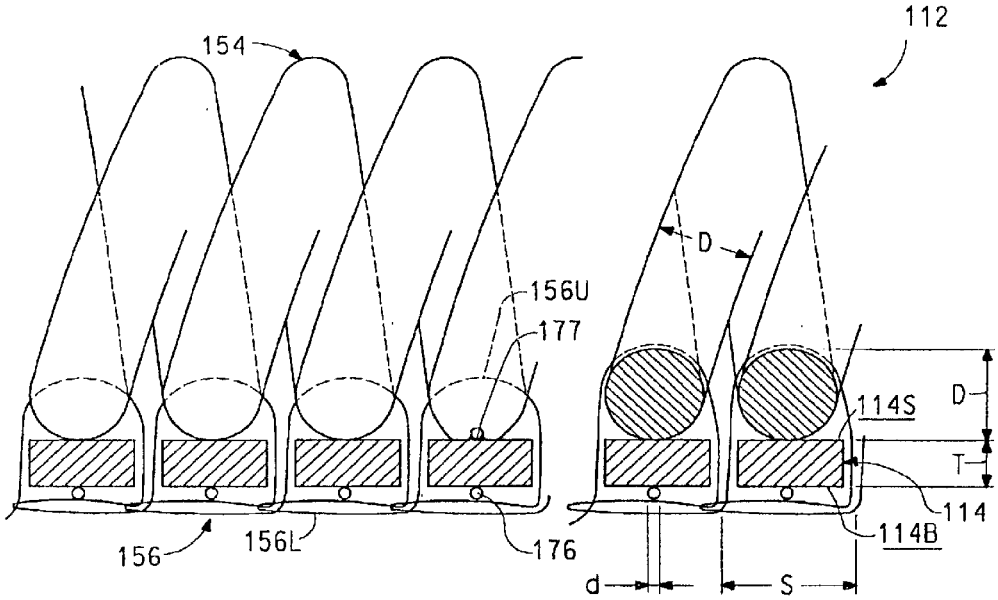
FIG. 6N is a side elevational illustrating a pile surface structure in accordance with the present invention having an array of weft-inserted reinforcing yarns incorporated therein.

Yet another additional or alternative feature of the pile surface structure 112 in accordance with the present invention is illustrated in FIG. 6N. An array of weft-extending reinforcing yarns 176 may be used to impart additional cross-directional strength to the pile surface structure 112. The weft-extending yarns 176 have the same properties as the stitching thread, that is, approximately one hundred to one thousand (100 to 1,000 dtex), high tenacity, and preferably also with moisture and temperature-stability. The weft-extending yarns 176 are preferably made from a hydrophobic or liquid repellent material, such as polyester. Alternatively, the yarns 176 may be treated with an agent that repels the liquid solvent or liquid binder carrier.

As seen in FIG. 6N the weft-inserted yarns 176 can be placed under the bottom surface 114B of the backing 114, and there held in place by the overlaps 156L of the chain stitches 156. The presence of the weft-inserted yarns 176 increases slightly the deknit length DKL needed for a tight stitch. If the weft-inserted yarn has a diameter "d", measured under near zero resistance, then the each stitch 156 has a theoretical thread deknit length DKL given by the approximate modified relationship:

$$DKL <= D\cdot(1+\pi/2)+(2\cdot T)+(2\cdot S)+(2\cdot d) \qquad (2')$$

As is also suggested in FIG. 6N, cross-laid weft-inserted reinforcing yarns 177 (also preferably of polyester) may also be inserted between the top surface 114S of the backing 114 and the root portions 160 of the pile yarn elements and held by the thread underlaps 156U.

The cross-laid weft-inserted reinforcing yarns 176 and 177 (if used) are supplied from dedicated supply rolls usually located to the side of the stitch bonding apparatus 110 (not visible in FIG. 5).

Figure 6O:
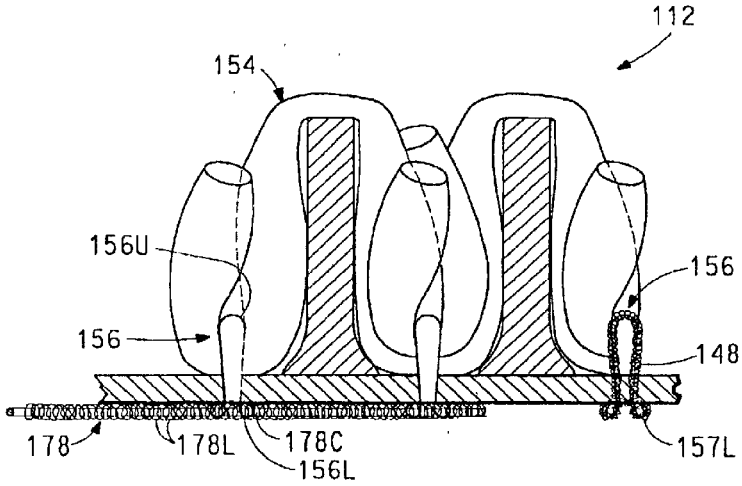
FIG. 6O is a front elevational view illustrating a pile surface structure in accordance with the present invention having incorporated therein an array of weft-inserted yarns each having a sheath of loops surrounding a core.

FIG. 6*o* illustrates yet another additional or alternative aspect of the pile surface structure 112 of the present invention. In the arrangement illustrated in the left hand portion of FIG. 6*o* an array of weft-extending attachment yarns 178 is held to the bottom surface 114B of the backing 114 by the overlap portions 156L of the chain stitches 156. In this instance, however, each attachment yarn 178 has a plurality of looped fibers 178L. The looped fibers 178L cooperate to form a sheath surrounding the core yarn 178C.

The attachment yarn 178 may be formed by the combination of bulked textured looped fibers 178L surrounding the taut straight/stiff core yarn 178C creating, on the bottom surface 114B of the backing, the "loop" portion of a "hook and loop" fastener system. The presence of the array of yarns 178 on the bottom surface 114 of the pile structure 112 defining such a "loop" portion makes installation of the structure 112 particularly expeditious.

The weft-extending attachment yarns 178 may be supplied from dedicated supply rolls usually located to the side of the stitch bonding apparatus 110 and inserted using a standard weft insertion apparatus (not visible in FIG. 5).

As is illustrated in the right hand portion of FIG. 60 it also lies within the contemplation of the present invention to form the stitches 156 from a stitching thread 148 that has loops 157L extending therefrom. As may be appreciated the loops 157L define the "loop" portion of a "hook and loop" fastener system. Although illustrated only in connection with FIG. 6*o* it should be understood that a stitching thread having loops 157L may be used in any embodiment of a pile surface structure illustrated in FIGS. 6A through 10 of this application.

Figure 6P:
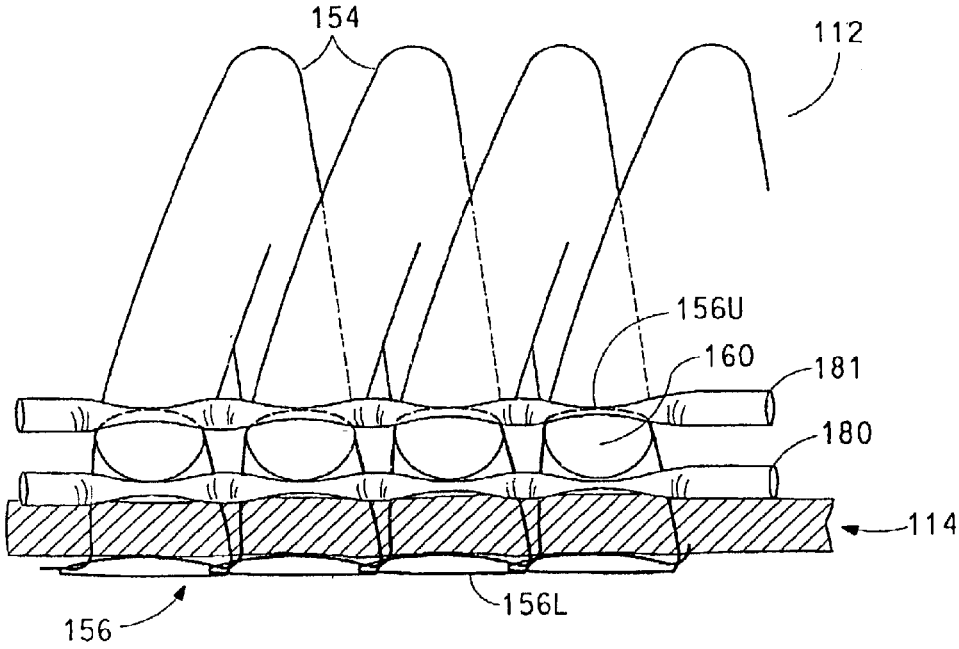
FIG. 6P is a side elevational view illustrating a pile surface structure in accordance with the present invention having an array of longitudinally-inserted reinforcing yarns incorporated therein.

As is illustrated in FIG. 6P still another additional or alternative feature of the present invention is to longitudinally reinforce the pile surface structure 112 by laying an array of reinforcing yarns 180 under or over the root portions of the pile surface structure. A second longitudinal reinforcing yarn 181 may also be used. The longitudinal reinforcing yarn(s) 180, 181 can be supplied to the stitching apparatus 110 from the supply rolls 107A, 107B (FIG. 5) or from a creel. The longitudinal reinforcing yarn(s) 180, 181 (preferably of polyester) may be laid-into the pile surface structure 112 from a separate, dedicated guide bar(s) 150R-1, 150R-2 shown in FIG. 6K. A 0-0/1-1 or 1-1/0-0 guide bar motion may be used. Indeed, in some instance it may be desirable to deploy simultaneously both the strand(s) 174A, 174B of binder material and the longitudinal reinforcing yarns 180, 181. Alternatively, a longitudinal reinforcing yarn, e. g., only the yarn 180 or 181, and/or a binder strand 174A, may be introduced under the backing 114 using special "under-sinker" guiding devices known in the art. Bi-component binder/reinforcing yarns can also be utilized through the apparatus of FIG. 6K.

In summary, the combination of chain stitching threads and optional warp-extending yarns reinforcing the machine direction, weft-extending yarns reinforcing the weft direction, inter-bonded with small amounts of added binder material (whether provided in layer, liquid or strand form) creates a soft, stable, lightweight and very efficient pile surface structure providing excellent face coverage with a relatively small amount of pile yarn free of wasted yarn in the back. All pile yarn filaments are bonded, resulting in high "tuft-bind" or tuft pull-out resistance, and in high resistance to filament pull-out. The bonded U-shaped root configuration provides pile crush resistance. In addition, superior dimensional stability is achieved if the backing (however implemented), the stitching threads, the reinforcing yarns, and the binder are comprised of a material that has high temperature and moisture stability. Polyester is the material of choice for all these components.

If the attachment yarns 178 or loopy stitching threads are used installation of the pile surface structure using a hook and loop fastener system is particularly advantageous. Moreover, using chemically compatible thermoplastic materials throughout, the pile surface structure of the present invention may be fully recyclable. The pile surface structure, if heat finished at temperatures over 250–300° F., is fully washable, dryable, and reusable, as well as wash or steam-cleanable during use or before recycling.

Figure 7A:
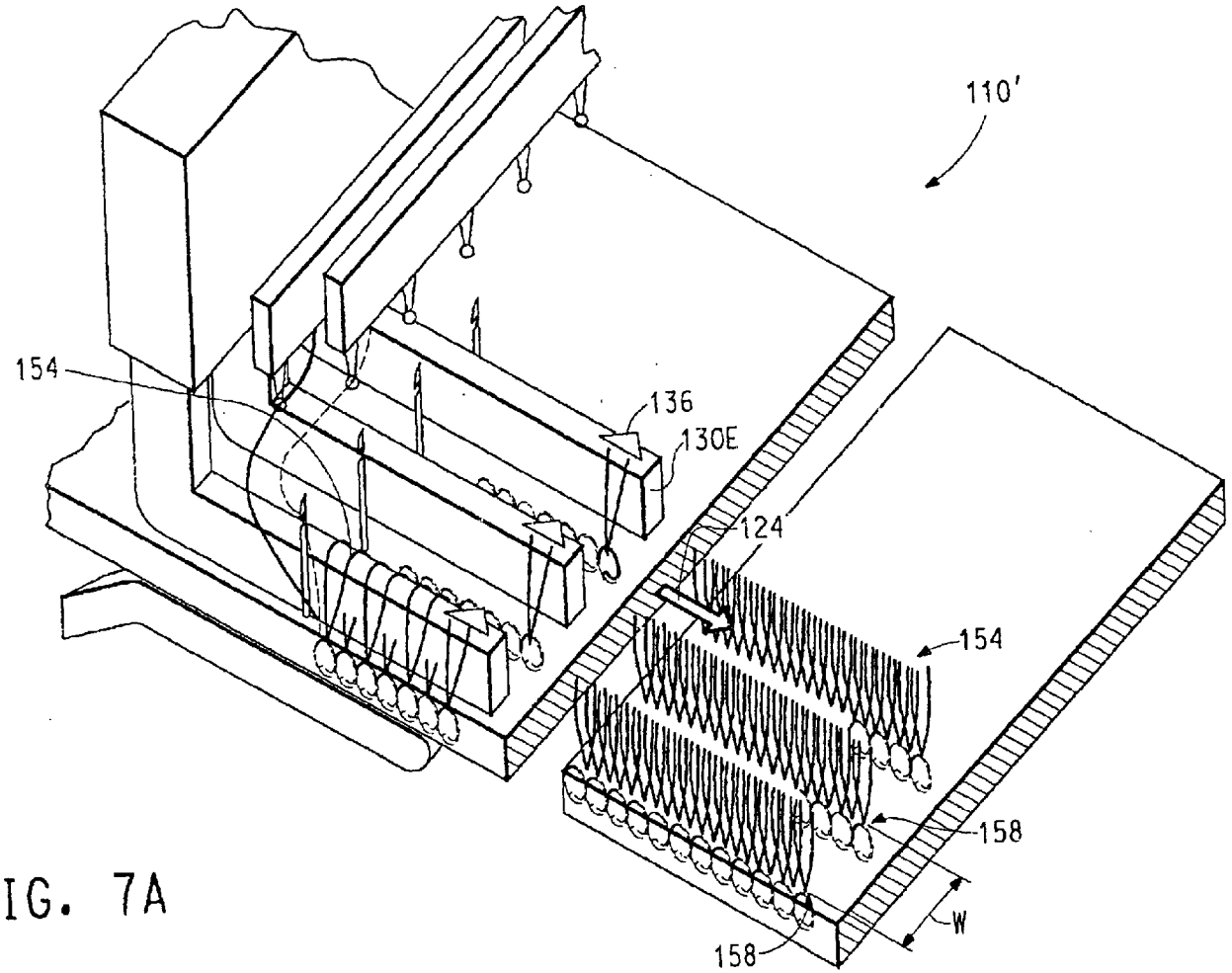

It lies within the contemplation of the present invention that the pile surface structure 112 having looped pile elements 154 as hereinbefore described, whether alternatively or additionally modified in any of the manner(s) discussed herein, may alternatively be implemented to create a cut pile surface structure. FIG. 7A is a stylized perspective view of a modified apparatus 110' for producing a laid-in stitched cut pile surface structure, while FIGS. 6B and 6C are respective front and side elevational views illustrating the cut pile surface structure produced by the apparatus of FIG. 7A.

In general, the cut pile surface structure is produced by cutting the loop pile element 154 (FIGS. 7B, 7C) near the apex 160A of the loop 160L. Cutting a pile loop portion 160L of the pile yarn element 154 results in a pair of cut pile elements 164A, 164B, Each cut pile element 164A, 164B has a generally U-shaped root portion 160 in the vicinity of each underlap 156U of the stitching thread. Each cut pile element 164A, 164B formed by severing a loop pile element has two substantially erect branches 165 extending from the U-shaped root portion 160. Expressed alternatively, a loop pile yarn element 154 as shown in FIGS. 6B, 6C may be considered as the pile structure defined by the integral jointure of one branch 165 of a cut pile element 164A lying in a first stitch line to a branch 165 emanating from a cut pile element 164B disposed in an adjacent stitch row.

Each branch 165 has a height H' measured from the top surface 114S of the backing 114 to a point near the tip 165T of the branch. The cut pile height H' is substantially equal to the height dimension 130H of the sinker fingers 130 used to form the loop pile from which the cut pile elements are produced.

A cut pile structure in accordance with the present invention preferably also satisfies the relationship $$H'/W>0.5 \quad (1A).$$

The deknit length equations (2A), (2B) or (2C) are also satisfied.

Figure 7B:
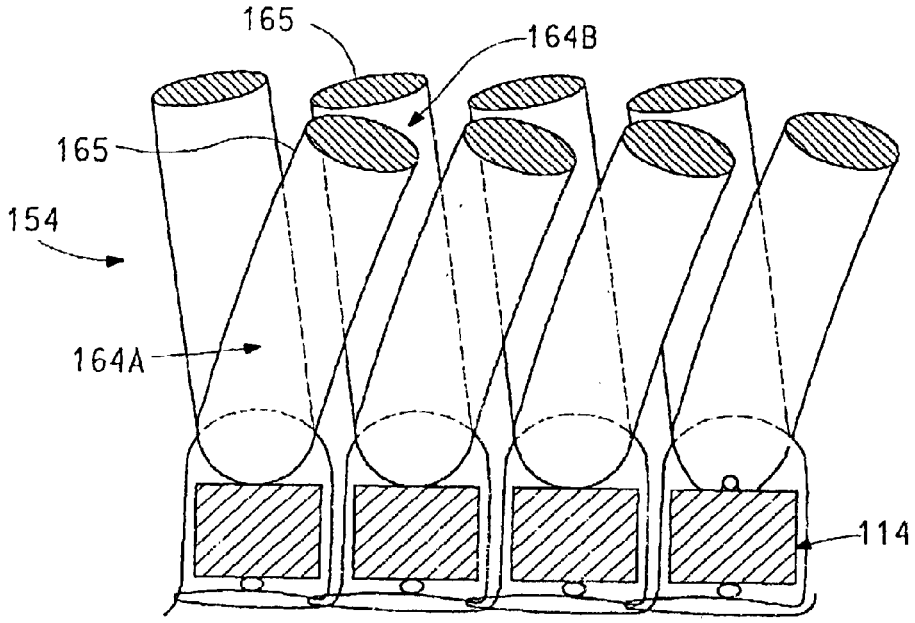
FIGS. 7B and 7C are, respectively, front and side elevational views illustrating the cut pile surface structure produced by the apparatus of FIG. 7A.
Figure 7C:
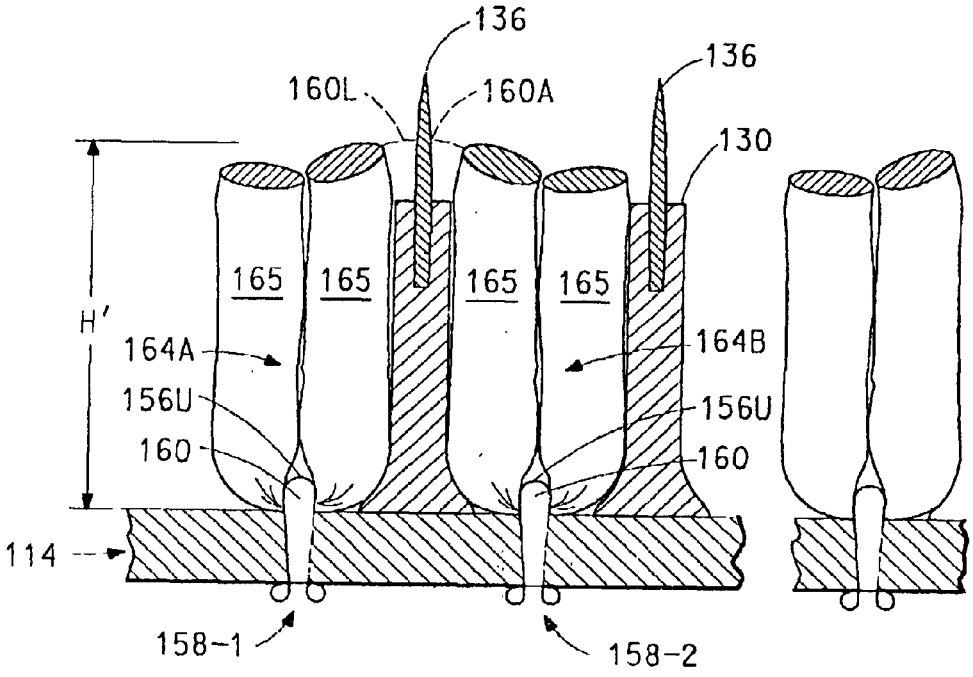

To form the cut pile elements of FIGS. 7B, 7C the apparatus 110 is modified as illustrated in FIG. 7A to include a suitable cutting implement 136 near the end 130E of each finger 130. In the arrangement illustrated in FIG. 7A the upper surface of the fingers 130 is slit and a cutting blade 136 is received within the slit. In practice the cutting edge of the blade 136 lies on the finger 130 a predetermined close distance (on the order of a one to five millimeters) past the needle-penetration line. As a pile loop advances along the surface of the finger 130 it is severed at its apex while still on the finger.

Alternatively, the pile loops may be cut with rotating blades or reciprocating blades placed in the same location as the stationary blades, and attached on to separate devices to engage and cut the loops as the emerge from the surface of the fingers 130.

The following examples are only meant for illustration, and not to cover the entire range of the possibilities of this invention.

EXAMPLE 1

A loop pile carpet-structure was formed on a modified ninety-six inch (96") wide Karl Mayer stitching unit, with the upper fingers and lower fingers arranged as per FIG. 6A. The elevation of the upper six-gage (six per inch) fingers was approximately eight millimeters over the backing. The backing was one hundred percent (100%) polyester Reemay® Style 2033 (100 gms/sq.m.) manufactured by Reemay Inc., Old Hickory, Tenn. The pile yarns were3700 denier bulked continuous filament (BCF) nylon, manufactured by E. I. du Pont de Nemours and Company ("DuPont"), Wilmington, Del. The pile yarns were fed from a six-gage (six per inch) guide-bar, equipped with wide spoon guides, making a 0-0/2-2 motion. A second six-gage guide bar, placed in front of the first bar, formed a 1-0/1-0 chain stitch between the elevated fingers, using 230 dtex high-tenacity polyester thread. The stitch frequency was at twelve courses per inch, at a speed of seven hundred (700) rpm. The needle bar was equipped with penetrating needles using linear closures. The process successfully formed a pile, approximately seven millimeter high, over the backing, secured by the polyester stitching thread. The total weight of the pile was 625 gms/sq.m., and the total weight of the structure 760 gms/sq.m. Despite the low pile weight the face of the backing was well-covered with the pile yarns, and the pile loops were very stable. When the product was heated to approximately 130° C., pulled in the machine direction, and cooled under tension, a small elongation of ten (10%) percent caused the self-locking chain stitches to tighten, and created a structure that required at least thirteen hundred (1,300) grams to pull an individual loop above the other loops.

Alternately, it was found that the application of only 160 gms per sq.m. dry weight of elastomeric latex resin, such as the textile grade resin sold by Rohm and Haas Corporation, Philadelphia, Pa., as "Rhoplex", applied as five percent (5%) solution in water increased loop pull-out strength to twenty-five hundred (2,500) grams, without the need of machine direction stretching. The latex binder appeared to concentrate in the filaments in the distended regions of the root portions of the pile elements.

EXAMPLE 2

The process of Example 1 was repeated, with the exception that the back-bar, carrying the 3700 denier yarns, was threaded with alternating colors at every second wale, and the bar had a 0-0/2-2, 2-2/4-4, 4-4/6-6, 6-6/4-4, 4-4/2-2, 2-2/0-0 motion, making an Atlas-type design, with colors alternating at every course. The total product weight, and all other parameters remained approximately the same as in Example 1.

EXAMPLE 3

The process and product of Example 1 was repeated, with the exception that a layer of nonwoven polypropylene 3.8 ounce/yard or 130 grams/sq.m.) was introduced over the original Reemay® backing. The layer of nonwoven polypropylene was that sold by DuPont under the trademark TYPAR®. The total weight of the stitched structure was measured at 887 grams/sq.m. The pile weight was calculated from the yarn consumption (the runner record) to be 453 grams/sq.m. Face coverage was excellent.

The product was heated for sixty (60) seconds under machine and cross-directional restraint to two hundred ten (210) degrees C. It shrunk approximately five (5%) percent in the machine direction after it was cooled and allowed to relax. The Typar® polypropylene sheet melted and attached itself mainly to the pile yarn roots around the chain stitches. The finished pile surface structure was flat and stable. Tuft pull-out force averaged approximately four thousand (4,000) grams.

EXAMPLE 4

The process and product of Example 3 was repeated, with the additional feature of a weft-inserted 840 denier high-tenacity polyester yarn attached to the system at the same longitudinal frequency as the stitches. The total product weight increased to 760 grams/sq.m. with the pile fibers at 485 grams/sq.m. All properties were approximately the same as Example 3, except that the finished pile surface structure was somewhat stiffer and much stronger in the cross-direction.

EXAMPLE 5

The process and product of Example 1 was repeated, with the additional feature of an extra guide bar between the chain stitching bar and the pile forming bar feeding a polypropylene 2,000 denier, 100 filament binder strand with a 1-1/0-0 motion, and a fourth guide bar feeding the same strand behind the pile yarn with a 0-0/1-1 motion. As a result two binder strands were placed, one over and one under the constricted root of the U-shaped pile elements, in a manner illustrated in FIGS. 6I and 6J. The total product weight was raised to 880 gms/sq.m., adding 120 g/sq.m. of binder strand. The stitched product was heated to 190 degrees C. while being held under weft-directional restraint and allowing the machine directional length to shrink approximately ten percent, starting a slightly visible puckering of the backing. After cooling the shrunk, binder-reinforced product weighed 970 gms/sq.m., had a binder distribution similar to FIG. 6E, and a tuft pull-out resistance of approximately 5,500 grams.

Some of the features earlier discussed in this application in the context of the pile surface structure 112 of the present invention may also find utility when applied to pile surface structures produced by apparatus of the prior art.

Figure 2A:
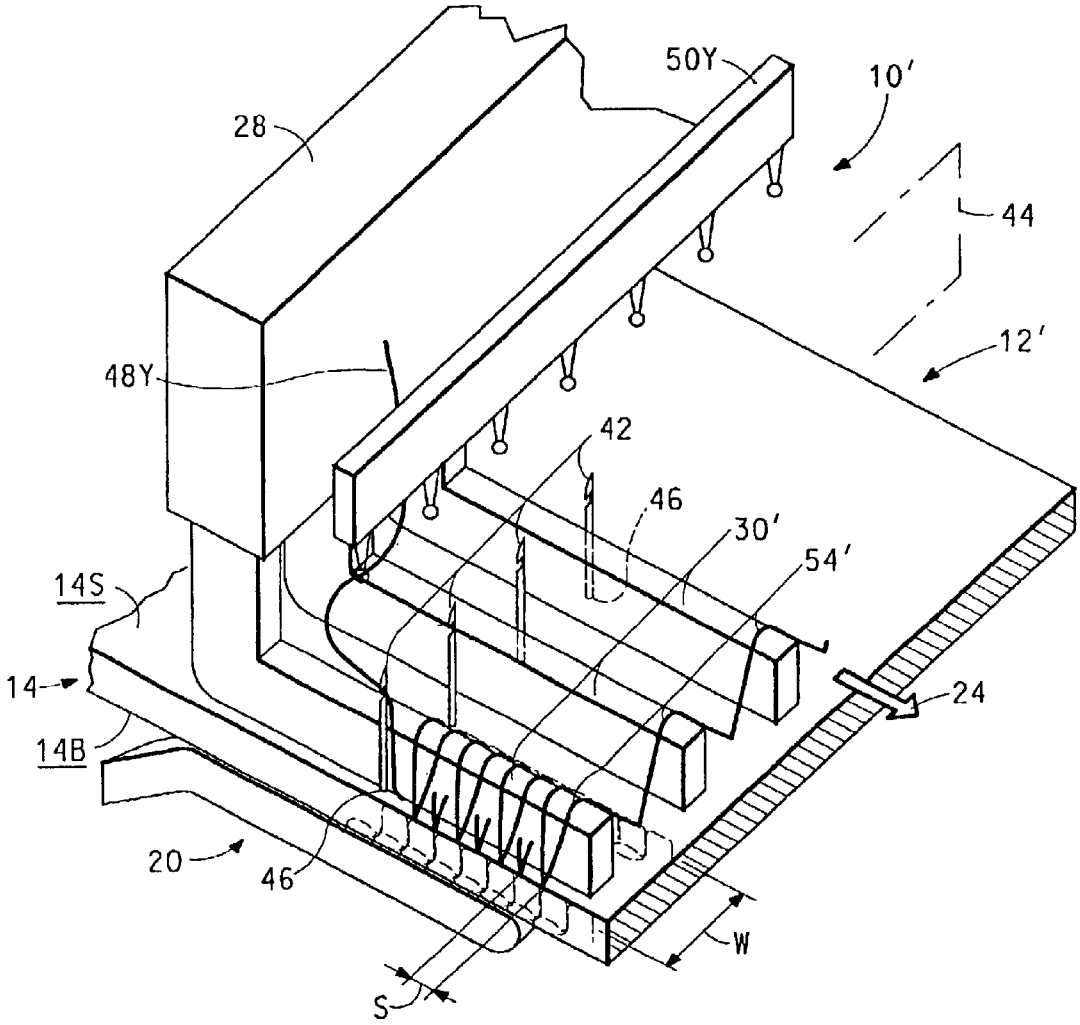
FIG. 2A (PRIOR ART)
Figure 2B:
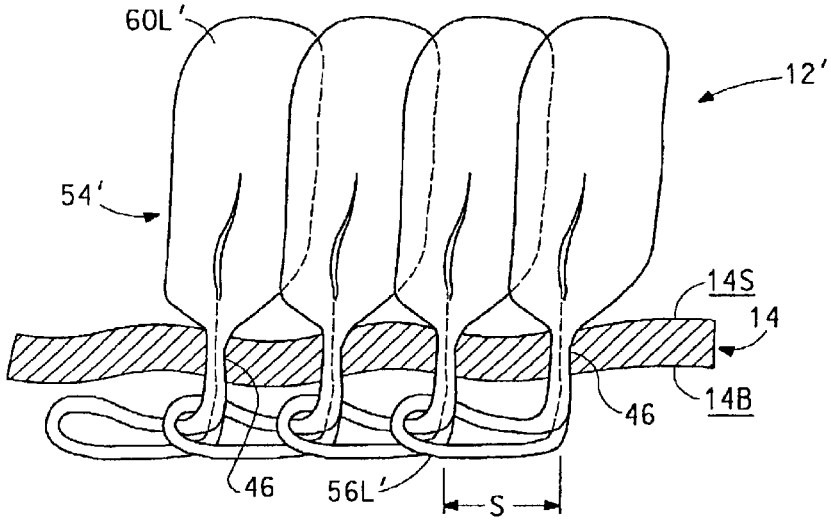
FIG. 2B (PRIOR ART)
FIGS. 2B and 2C are side and front elevational views, respectively, of the stitch-bonded structure of the prior art produced by the apparatus of FIG. 2A.
Figure 2C:
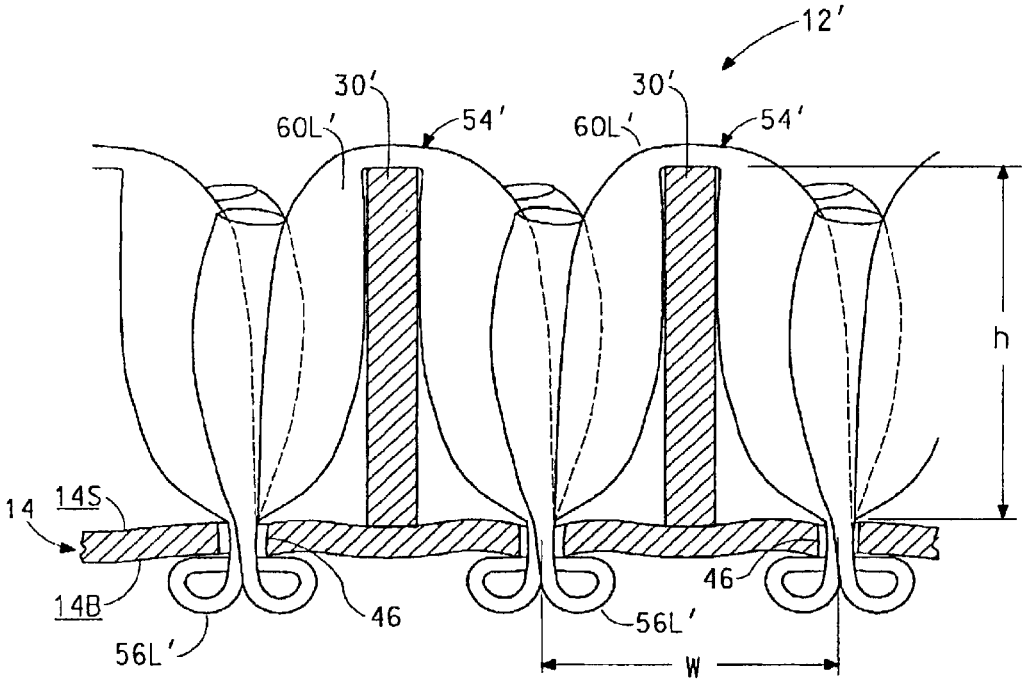
FIG. 2C (PRIOR ART)
Figure 3A:
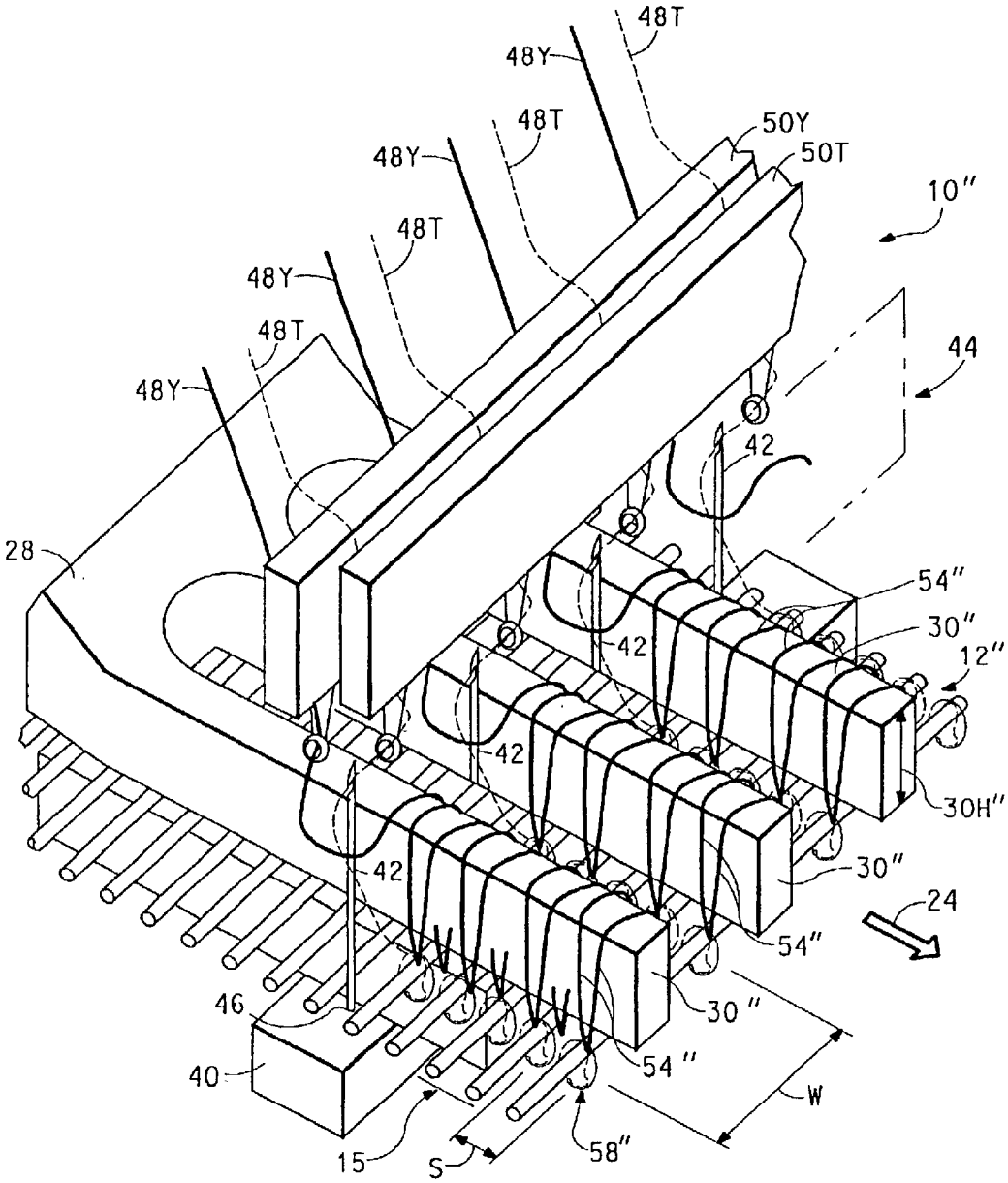
FIG. 3A (PRIOR ART)
Figure 3B:
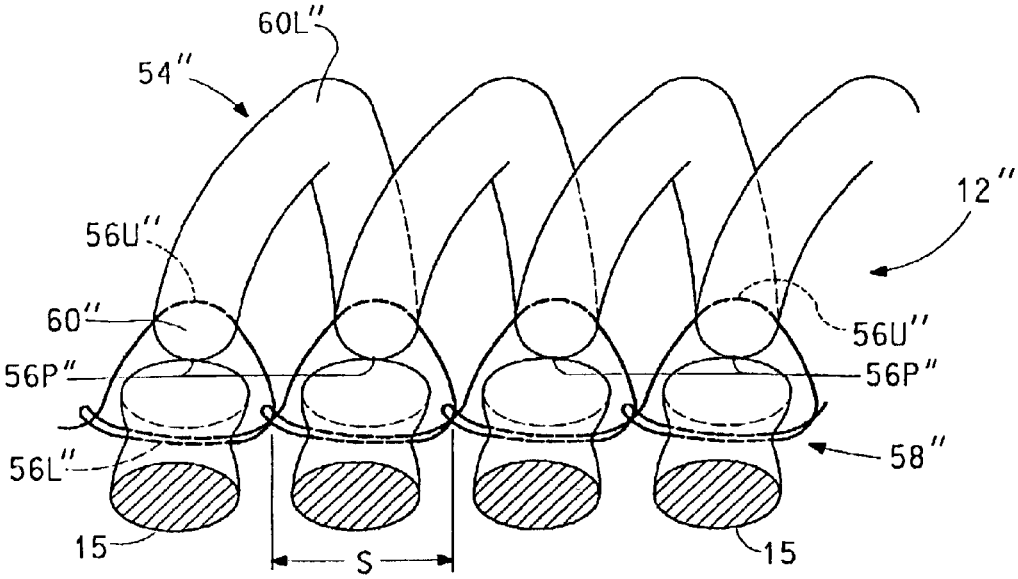
FIG. 3B (PRIOR ART)
FIGS. 3B and 3C are side and front elevational views, respectively, of the stitch-bonded structure of the prior art produced by the apparatus of FIG. 3A.
Figure 3C:
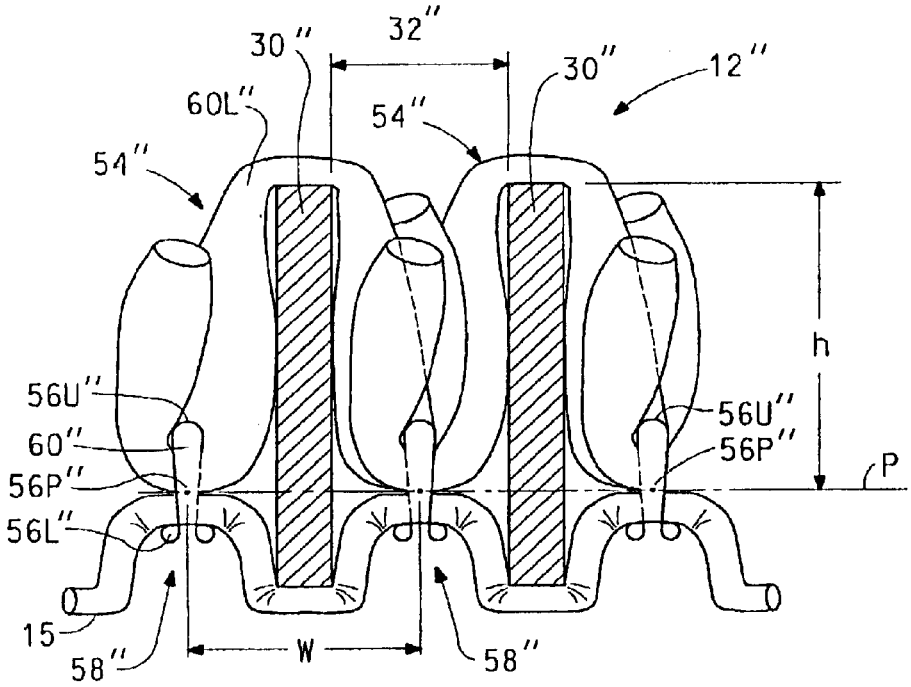
FIG. 3C (PRIOR ART)
Figure 8A:
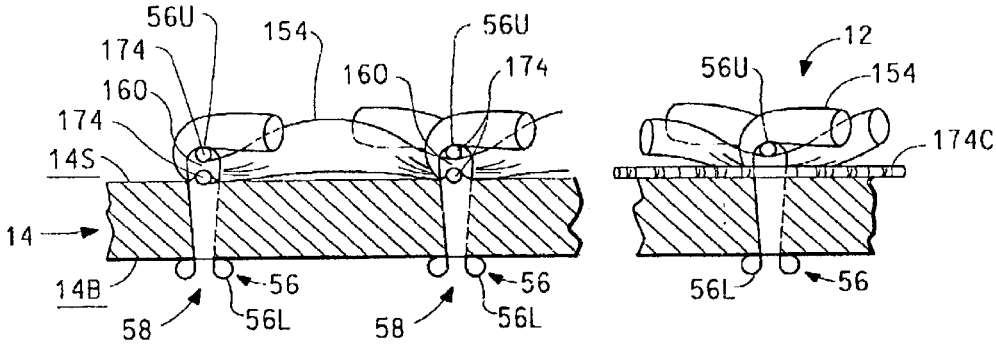
FIGS. 8A, 8B and 8C are front elevational views respectively similar to FIGS. 1B, 2B and 3B, showing surface structures produced by the apparatus of FIGS. 1A, 2A and 3A, respectively, each as modified in accordance with the present invention to incorporate longitudinally-inserted strands of binder material therein.
Figure 8B:
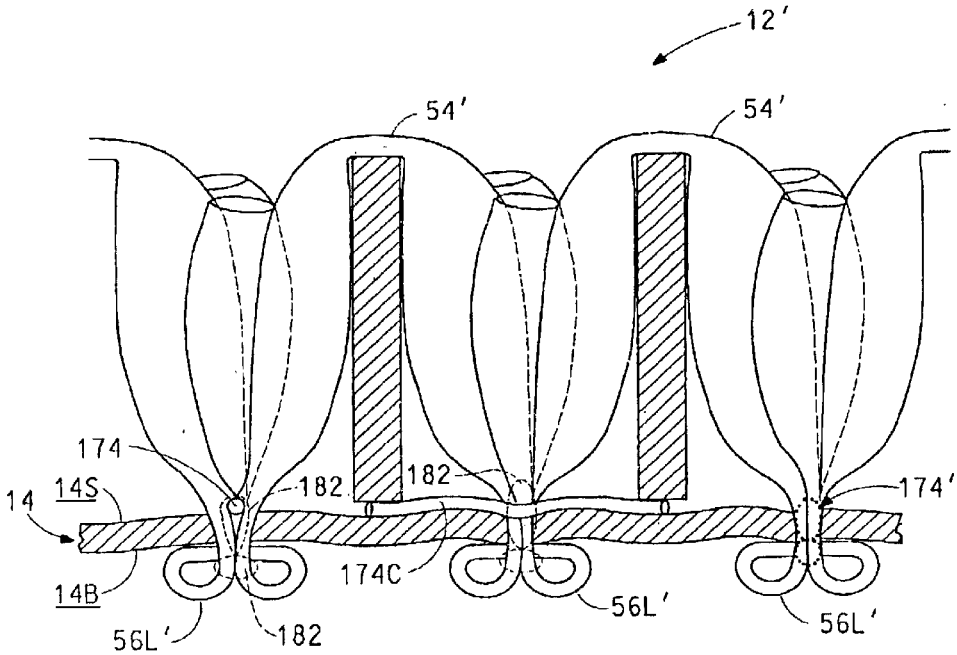
Figure 8C:
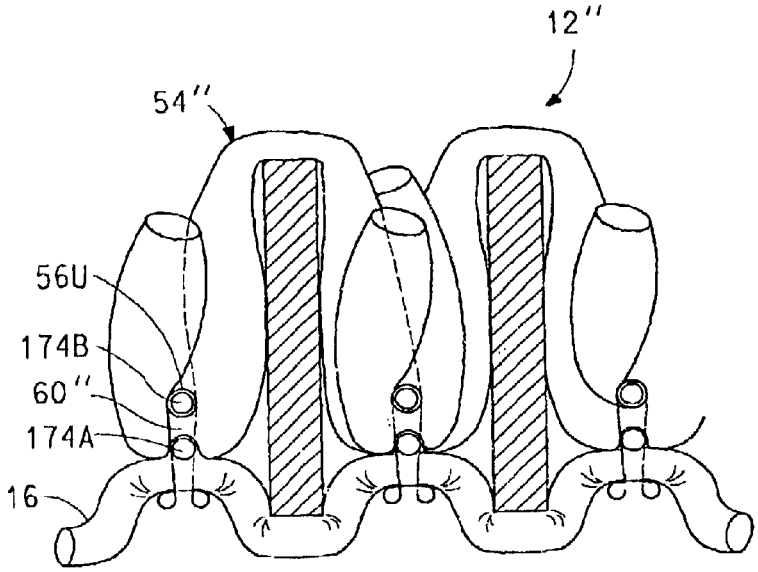
Figure 9A:
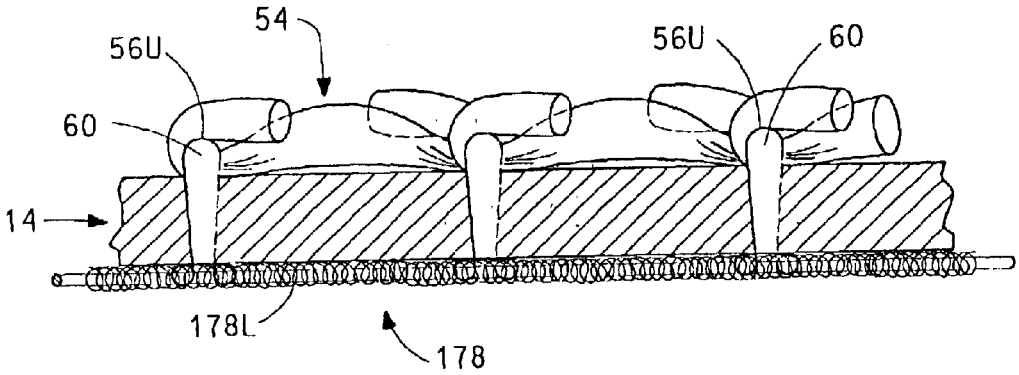
FIGS. 9A, 9B and 9C are front elevational views respectively similar to FIGS. 1B, 2B and 3B, showing surface structures produced by the apparatus of FIGS. 1A, 2A and 3A, respectively, each as modified in accordance with the present invention to incorporate therein an array of weft-inserted yarns each having a sheath of loops surrounding a core.
Figure 9B:
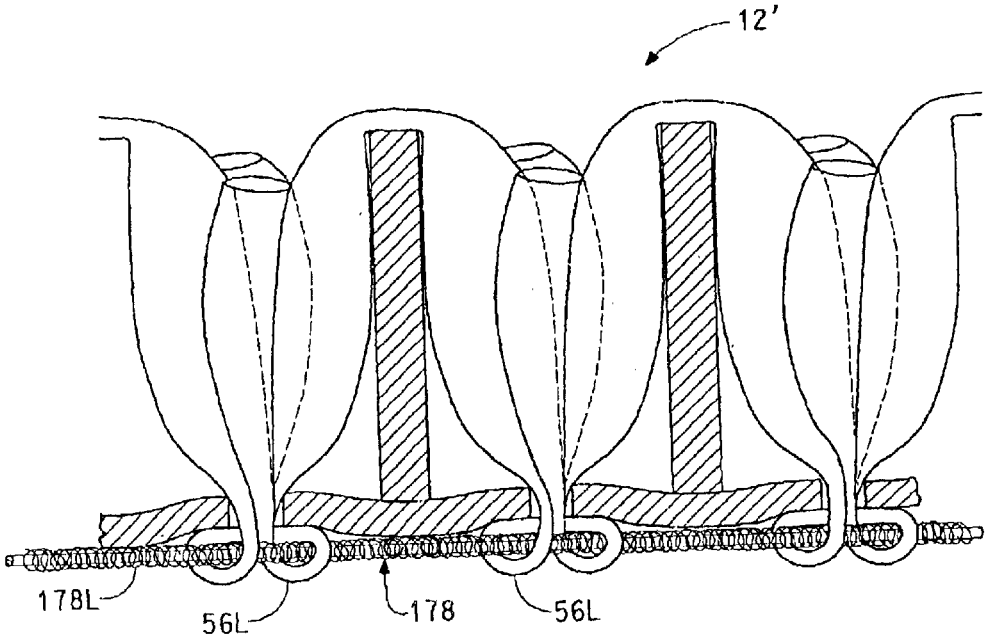
Figure 9C:
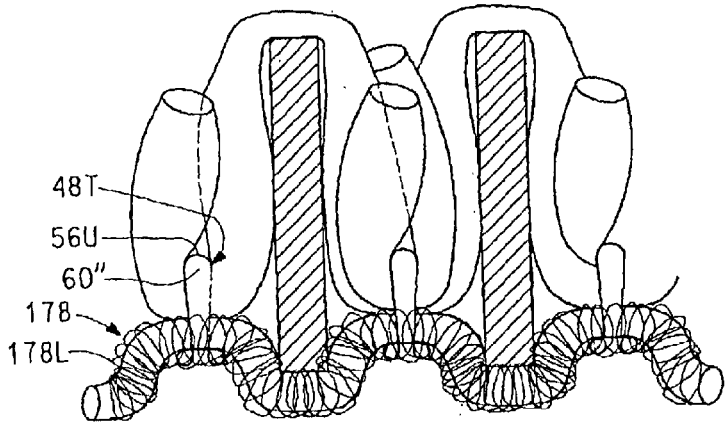

FIGS. 8A, 8B and 8C illustrate the incorporation of longitudinally extending strands 174 of binder material (as in FIGS. 6I, 6J and 6L) and/or weft-extending strands 174C of binder material into the structures produced by the apparatus of FIGS. 1A, 2A and 3A, respectively. FIGS. 9A, 9B and 9C illustrate the incorporation of an array of weft-inserted attachment yarns 178 (as in FIG. 6*o*) into the pile surface structures produced by the apparatus of FIGS. 1A, 2A and 3A, respectively.

With reference to FIG. 8A shown is a stitched pile surface structure having a backing 14, a plurality of rows of inlay pile elements 154 disposed over the top surface of the backing 14, and a plurality of parallel lines 58 of stitches 56 extending longitudinally along the backing 14. Each pile element 154 has a root portion 160 held against the backing 14 by the underlap portion 56U of one of the stitches 56.

In accordance with the present invention at least one longitudinally extending strand 174 of binder material is disposed against the root portion 60 of substantially all of the pile elements. If only a strand 174 is deployed, it may be disposed either above or below the root portion 60. If desired, a second longitudinally extending strand 174 of binder material may be included, at a location depending upon the location of the first strand 174. The longitudinal strand(s) can be deployed using the apparatus of FIG. 1A provided with an additional guide bar(s) making a 0-0/1-1 or 1-1/0-0 motion.

Weft-extending strands 174C of binder material can also be deployed in the pile surface structure. This arrangement is indicated in the right hand portion of FIG. 8A. If used, the weft-extending strands 174C can be introduced via weft insertion, fed by bobbins on the side(s) of the stitching machine.

The longitudinally extending strands 174 and the weft-extending strand 174C can be implemented using any of the materials as hereinbefore described, including a composite of a low-temperature melting temperature binder material and a higher melting temperature material. The thread used to form the stitches 56 can likewise be implemented in any form as hereinbefore described can be used, including a stitching thread formed of a composite of a low-temperature melting temperature binder material and a higher melting temperature material.

In FIG. 9A the structure 12 also includes an array of weft-inserted attachment yarns 178 held to the bottom surface 14B of the backing 14 by the overlap portion 56L of the stitch 56. As discussed earlier in connection with FIG. 6*o* each weft-inserted attachment yarn 178 has a plurality of looped fibers 178L. The looped fibers 178L (or the stitching threads having loops 157L) form the "loop" portion of a hook and loop fastener system, thus expediting the installation of the pile structure 12. The attachment yarn 178 is deployed using a weft insertion apparatus (not shown).

With reference to FIG. 8B shown is a stitch-in structure 12' produced by the apparatus of FIG. 2A. The structure 12' has a backing 14 with a top surface 14S and a bottom surface 14B. A plurality of rows of loop pile elements 54' is stitched into the backing 14. Each loop pile element 54' has an interconnecting overlap 56L' disposed against the bottom surface of the backing.

Again, in accordance with the present invention, at least one longitudinally extending inlaid strand 174 of binder material is disposed against the top surface 14S of the backing 14. As seen in the left-hand portion of FIG. 8B an additional separate stitching thread 182 secures the strand 174 of binder material to the backing 14. The inlaid strand 174 can be deployed using the apparatus of FIG. 2A provided with an additional guide bar making a 0-0/1-1 or 1-1/0-0 motion. The stitching thread 182 is deployed with a second additional guide bar making a 1-0/1-0, 1-0/0-1 or 0-1/1-0 motion. As shown in the central portion of FIG. 8B, weft-extending strands 174C of binder material, held by the threads 182, can be introduced into the pile surface structure.

In an alternate implementation (illustrated in the right-hand portion of FIG. 8B) the one strand 174' of binder material forms a chain stitch that interlocks with the overlap 56L' of each pile element 54'. The strand 174' is deployed using the apparatus of FIG. 2A provided with an additional guide bar making a 1-0/1-0, 1-0/0-1 or 0-1/1-0 motion.

The longitudinally extending strands 174, the weft-extending strand 174C, the strand 174', and the stitching thread 182 can be formed using any of the materials as hereinbefore described, including a composite of a low-temperature melting temperature binder material and a higher melting temperature material.

FIG. 9B illustrates the structure 12' as including an array of weft-extending attachment yarns 178 held to the bottom surface 14B of the backing 14 by the overlap portion 56L' of the stitched-in yarn element 54'. The attachment yarn 178 shown in FIG. 9B is deployed using a weft insertion apparatus (not shown).

With reference to FIG. 8C shows a stitch-bonded structure 12" produced by the apparatus of FIG. 3A. The structure 12" includes an array 16 of cross-laid weft-inserted yarns in place of a backing. A plurality of rows of loop pile elements 54", each having a root portion 60" that is held to the weft yarns 16 by the underlap portion 56U" of one of the chain stitches. The stitches are arranged in parallel rows that extend longitudinally along the weft-extending array of yarns 16. At least one longitudinally extending strand 174A of binder material is held against the root portion of substantially all of the pile elements 54" by the underlap 56". An additional strand 174B may be used, if desired. The strand(s) 174A, 174B is/are deployed using the apparatus of FIG. 3A provided with an additional separate guide bar(s) making a 0-0/1-1 or 1-1/0-0 motion. In addition, weft-extending strands 174C of binder material can be held into the pile surface structure by the underlaps 56U of the stitching threads 48T. The longitudinally extending strands(s) 174A, 174B, and the stitching threads can be formed using any of the materials as hereinbefore described, including a composite of a low-temperature melting temperature binder material and a higher melting temperature material. The weft-extending yarns 16 can likewise be implemented in any form as hereinbefore described can be used, including a stitching thread formed of a composite of a low-temperature melting temperature binder material and a higher melting temperature material.

FIG. 9C illustrates that attachment yarns 178 may be used to form the array 16 of cross-laid weft-inserted yarns 178L. It should also be appreciated that stitching threads having loops 157L (such as shown in FIG. 6*o*) can also be used to form loops for a hook and loop fastener system.

It should be noted if binder material is deployed as shown in FIGS. 8A, 8B and 8C, that binder material must be activated, as discussed in connection with FIG. 6L.

Figure 4:
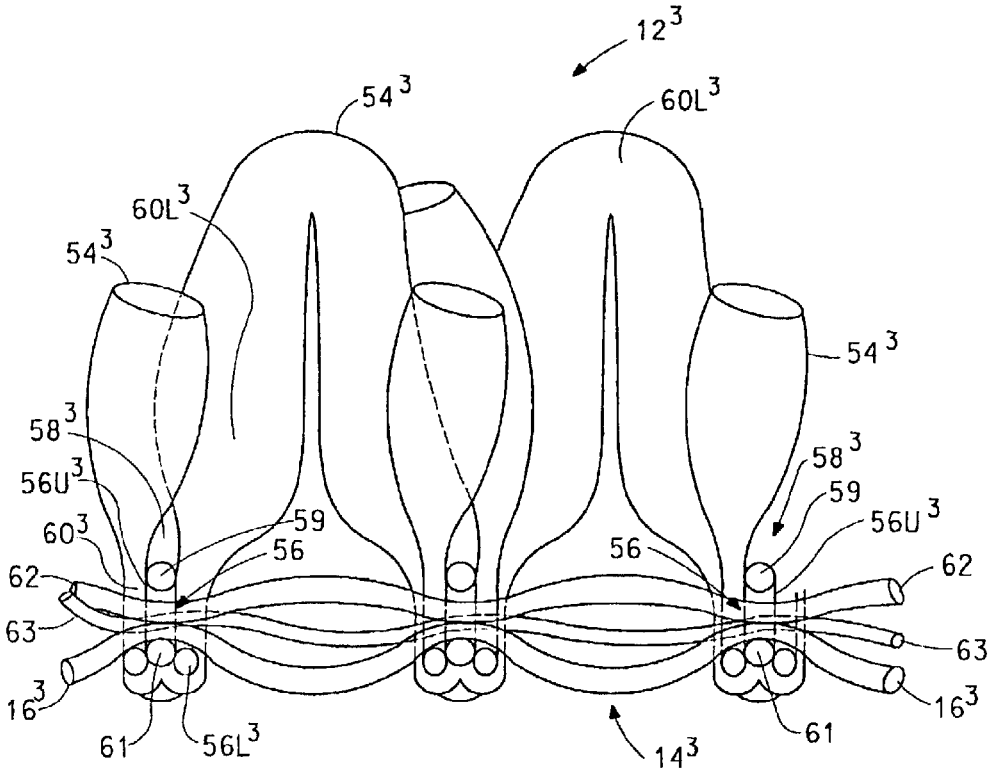
FIG. 4 (PRIOR ART)
FIG. 4 is a front elevational view of a knit structure of the prior art.
Figure 10:
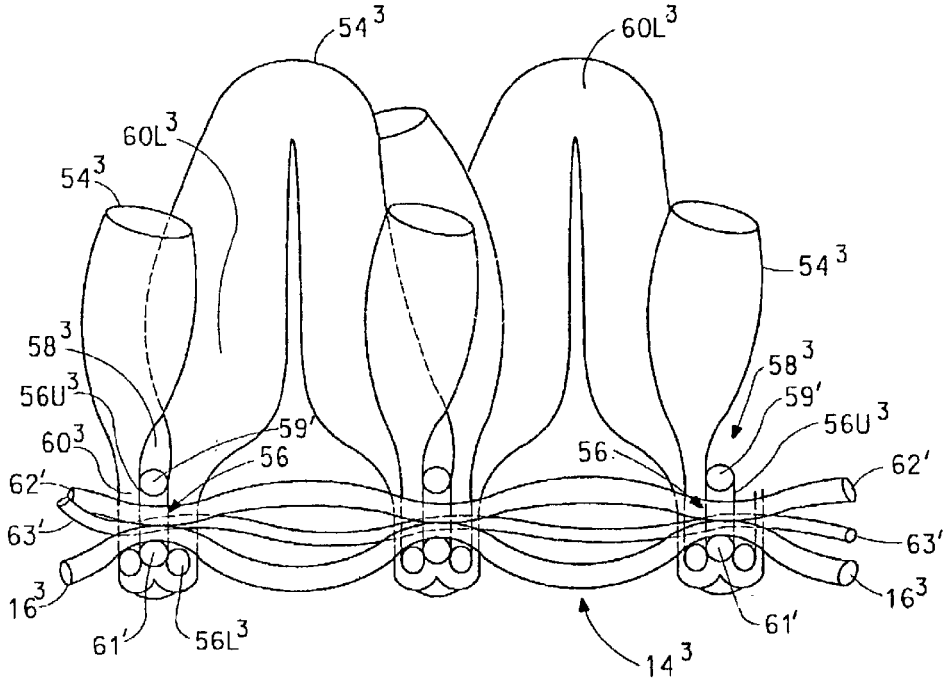
FIG. 10 is a front elevational view of a knit pile fabric similar to FIG. 4 showing strands of binder material held within the structure by the stitching threads.

In an alternate implementation illustrated in FIG. 10 is a stylized front elevational view of a knit pile structure similar to that shown in FIG. 4. The root portion $\mathbf{60}^3$ of each stitched-in pile yarn loop $\mathbf{60}L^3$ is secured by an underlap $\mathbf{56}U^3$ of a stitch 56 to the weft yarns $\mathbf{16}^3$ that form a backing $\mathbf{14}^3$. The stitches 56 are longitudinally interlocked by chained overlap portions $\mathbf{56}L^3$ that extend under the weft yarns $\mathbf{16}^3$.

Strands 59' or 61', formed of a binder material, can be placed over and under the roots of the pile yarns in the longitudinal direction, enclosed and held simultaneously with the pile roots by the underlaps $\mathbf{56}U^3$ and overlaps $\mathbf{56}L^3$ of the stitches 56. A planar layer of laid-in strands 62' or 63', which extend in the weft direction or are laid in a pattern such as 0-0/2-2, 0-0/3-3, are held by the underlaps $\mathbf{56}U^3$ and overlaps $\mathbf{56}L^3$ of the chain stitches 56. The strands 62' or 63' may be formed of a binder material. A strand such as 62' or 63' of a binder material would serve to melt into the roots of the pile yarns and reinforce the whole structure. By choosing the appropriate strand or strands and the appropriate weight, knit pile structures wherein the binder is concentrated in the critical points (rather that throughout the back face) can be thus obtained. The strands 59', 61', 62' and/or 63' (as well as the stitching threads used to form the stitches 56), can be formed from a composite of a low-temperature melting temperature binder material and a higher melting temperature material. It should again be appreciated that stitching threads having loops 157L (such as shown in FIG. 6*o*) can also be used to form loops for a hook and loop fastener system.

Those skilled in the art, having the teachings of the present invention as hereinabove set forth, may impart numerous modifications thereto. Such modifications are to be construed as lying within the contemplation of the present invention, as defined by the appended claims.

What is claimed is:

1. A stitching process for forming a pile surface structure using a stitching apparatus having first and second needles, each needle penetrating a backing at respective needle penetration points, the backing having a layer of a binder material on a first surface thereof, the process including the steps of:

(a) at positions disposed above the first surface of backing, looping a first and a second stitching thread around respective first and second locations along a pile-forming yarn itself formed from a plurality of filaments;

(b) using the first and second needles, drawing both the first and the second stitching threads toward and through the backing to cause the pile forming yarn to train over a sinker finger thereby to form a plurality of pile loop elements each having a pile height substantially equal to the finger height H and stitching thread underlaps, each pile element having a U-shaped root portion, the stitching thread underlaps holding and constricting each root portion against the first surface of backing, the underlaps forming distended regions on each side of the constriction in the root portions of substantially all of the pile elements; and (c) thereafter, applying heat to activate the binder material and thereby to place a mass of binder material within the pile surface structure such that substantially all of the filaments in the distended regions in the root portions of substantially all of the pile elements have binder material thereon.

2. The stitching process of claim 1 wherein the first and second needles are laterally spaced by a predetermined needle spacing distance W, the needles forming parallel longitudinal lines of needle penetration points in the backing, each needle penetration point in each longitudinal line being spaced from a longitudinally adjacent needle penetration point by a distance S, the apparatus also having a sinker finger disposed laterally intermediate the first and second needles and longitudinally forwardly of the needle penetration points, the sinker finger having a height dimension H, wherein, as the needles draw the first and the second stitching threads toward and through the backing the pile forming yarns are caused to train over the sinker finger whereby each of the plurality of pile elements has a loop portion, each loop portion having a height substantially equal to the finger height H, wherein the ratio of the predetermined pile height H to the predetermined spacing W satisfies the relationship:

$$H/W>0.5.$$

3. The stitching process of claim 1, further comprising the step of:

using a cutting implement, cutting the pile elements to form pairs of generally U-shaped cut pile elements.

4. The stitching process of claim 1, wherein the backing further comprises a weft-extending array of reinforcing yarns.

5. The stitching process of claim 1, wherein each stitching thread comprises a composite of a low melting temperature binder material and higher melting temperature binder material.

6. The stitching process of claim 1, wherein the stitching thread has a denier that is one-half of the denier of the pile forming yarns.

7. The stitching process of claim 1, wherein the stitching thread has a denier that is one-third of the denier of the pile forming yarns.

8. A stitching process for forming a pile surface structure using a stitching apparatus having first and second needles, each needle penetrating a backing at respective needle penetration points, the process including the steps of:

(a) at positions disposed above the first surface of backing, looping a first and a second stitching thread around respective first and second locations along a pile-forming yarn itself formed from a plurality of filaments;

(b) using the first and second needles, drawing both the first and the second stitching threads toward and through the backing to cause the pile forming yarn to train over a sinker finger thereby to form a plurality of pile loop elements each having a pile height substantially equal to the finger height H and stitching thread underlaps, each pile element having a U-shaped root portion, the stitching thread underlaps holding and constricting each root portion against the first surface of backing, the underlaps forming distended regions on each side of the constriction in the root portions of substantially all of the pile elements;

(c) placing a strand of binder material against the root portion of the pile element such that the binder strand is held by the underlaps; and (d) thereafter, applying heat to activate the binder material and thereby place a mass of binder material within the pile surface structure such that substantially all of the filaments in the distended regions in the root portions of substantially all of the pile elements have binder material thereon.

9. The stitching process of claim 8 wherein the first and second needles are laterally spaced by a predetermined needle spacing distance W, the needles forming parallel longitudinal lines of needle penetration points in the backing, each needle penetration point in each longitudinal line being spaced from a longitudinally adjacent needle penetration point by a distance S, the apparatus also having a sinker finger disposed laterally intermediate the first and second needles and longitudinally forwardly of the needle penetration points, the sinker finger having a height dimension H, wherein, as the needles draw the first and the second stitching threads toward and through the backing the pile forming yarns are caused to train over the sinker finger whereby each of the plurality of pile elements has a loop portion, each loop portion having a height substantially equal to the finger height H, wherein the ratio of the predetermined pile height H to the predetermined spacing W satisfies the relationship:

$$H/W>0.5.$$

10. The stitching process of claim 8 wherein the step (c) places the strand of binder material in the longitudinal direction.

11. The stitching process of claim 8 wherein the step (c) places the strand of binder material in the weft direction.

12. The stitching process of claim 10 or 11 wherein each strand of binder material comprises a composite of a low melting temperature binder material and higher melting temperature material.

13. The stitching process of claim 8, further comprising the step of using a cutting implement, cutting the pile elements to form pairs of generally U-shaped cut pile elements.

14. The stitching process of claim 8, wherein the backing further comprises a weft-extending array of reinforcing yarns.

15. The stitching process of claim 8, wherein each stitching thread comprises a composite of a low melting temperature binder material and higher melting temperature material.

16. A stitching process for forming a pile surface structure using a stitching apparatus having first and second needles, the process including the steps of:

(a) at positions disposed above the first surface of backing, looping a first and a second stitching thread around respective first and second locations along a pile-forming yarn itself formed from a plurality of filaments;

(b) using the first and second needles, forming a plurality of pile elements and stitching thread underlaps that hold each pile element, thereby to form a pile surface structure;

(c) using the first and second needles, drawing both the first and the second stitching threads toward and through the backing to cause the pile forming yarn to train over a sinker finger thereby to form a plurality of pile loop elements each having a pile height substantially equal to the finger height H and stitching thread underlaps, each pile element having a U-shaped root portion, the stitching thread underlaps holding and constricting each root portion against the first surface of backing, the underlaps forming distended regions on each side of the constriction in the root portions of substantially all of the pile elements; and (d) stretching the pile surface structure in the longitudinal direction by at least two to twenty (2%–20%) percent to tighten the stitching threads holding the pile elements; and (e) thereafter, applying heat to activate the binder material and thereby to place a mass of binder material within the pile surface structure such that substantially all of the filaments in the distended regions in the root portions of substantially all of the pile elements have binder material thereon.

17. The process of claim 16 wherein the pile elements have root portions, further comprising the steps of:

(f), before step (d), placing a strand of binder material against the root portion of substantially all of the pile elements, and, (g) during stretching step (d), adding heat to activate the binder material.

18. The process of claim 16 wherein the stitching thread underlaps hold the pile elements against a backing, the backing having a layer of binder material on a first surface thereof, the method further comprising the step of:

(f) during stretching step (d), adding heat to activate the binder material.

19. The process of claim 16 wherein the stitching thread underlaps hold the pile elements against a backing, the backing having a bottom surface thereon, the method further comprising the step of:

before step (d), (f) applying through the bottom surface of the backing a liquid carrier having a binder material therein.

20. The process of claim 19 further comprising the step of before step (f), (g) treating of the bottom surface of the backing with a material that repels liquid.

21. The process of claim 19 wherein the bottom layer of the backing is formed of a material that repels liquid.

22. The process of claim 16 wherein the stitching thread underlaps hold the pile elements against a backing, and wherein the apparatus also has a sinker finger disposed laterally intermediate the first and second needles, the sinker finger having a height dimension H, the backing is held in place at a set distance from the top of the sinker fingers, thereby to control the height of the pile elements.

23. The process of claim 16 further comprising the step of: (f) using a cutting implement, cutting the pile elements to form pairs of cut pile elements.

24. A stitching process for forming a pile surface structure using a stitching apparatus having first and second needles, the process including the steps of:

(a) at positions disposed above the first surface of backing, looping a first and a second stitching thread around respective first and second locations along a pile-forming yarn itself formed from a plurality of filaments;

(b) using the first and second needles, forming a plurality of pile elements and stitching thread underlaps that hold each pile element, thereby to form a pile surface structure;

(c) using the first and second needles, drawing both the first and the second stitching threads toward and through the backing to cause the pile forming yarn to train over a sinker finger thereby to form a plurality of pile loop elements each having a pile height substantially equal to the finger height H and stitching thread underlaps, each pile element having a U-shaped root portion, the stitching thread underlaps holding and constricting each root portion against the first surface of backing, the underlaps forming distended regions on each side of the constriction in the root portions of substantially all of the pile elements; and (d) applying heat sufficient to shrink permanently the stitching threads; and (e) thereafter, applying heat to activate the binder material and thereby to place a mass of binder material within the pile surface structure such that substantially all of the filaments in the distended regions in the root portions of substantially all of the pile elements have binder material thereon.

25. The process of claim 24 wherein the pile elements have root portions, further comprising the steps of:

(f) before step (d), placing a strand of binder material against the root portion of substantially all of the pile elements, the heat applied during the shrinking step (d) activating the binder material.

26. The process of claim 24 wherein the stitching thread underlaps hold the pile elements against a backing, the backing having a layer of binder material on a first surface thereof, the heat applied during the shrinking step (d) activating the binder material.

27. The process of claim 24 wherein the stitching thread underlaps hold the pile elements against a backing, the backing having a bottom surface thereon, the method further comprising the step of:

before step (d), (f) applying through the bottom surface of the backing a liquid carrier having a binder material therein, the heat applied during the shrinking step (d) activating the binder material.

28. The process of claim 25 further comprising the step of before step (f), (g) treating of the bottom surface of the backing with a material that repels liquid.

29. The process of claim 27 wherein the bottom surface of the backing is formed of a material that repels liquid.

30. The process of claim 24 wherein the stitching thread underlaps hold pile elements against a backing, and wherein the apparatus also having a sinker finger disposed laterally intermediate the first and second needles and longitudinally forwardly of the needle penetration points, the sinker finger having a height dimension H, the backing is held in place at a set distance from the top of the sinker fingers, thereby to control the height of the pile elements.

31. The process of claim 24 further comprising the step of: (f) using a cutting implement, cutting the pile elements to form pairs of cut pile elements.

32. The process of claim 24 wherein the permanent shrinkage of the stitching threads is in the range from about five percent (5%) to about thirty percent (30%).

* * * * *